US011045824B1

(12) United States Patent
Duffin et al.

(10) Patent No.: US 11,045,824 B1
(45) Date of Patent: Jun. 29, 2021

(54) NOZZLE ASSEMBLY WITH ROTATING NOZZLE INSERT

(71) Applicant: XCAD VALVE AND IRRIGATION, INC., Paul, ID (US)

(72) Inventors: Don Duffin, Paul, ID (US); Roger Duffin, Paul, ID (US); Casey Nutt, Paul, ID (US)

(73) Assignee: XCAD VALVE AND IRRIGATION, INC., Paul, ID (US)

( * ) Notice: Subject to any disclaimer, the term of this patent is extended or adjusted under 35 U.S.C. 154(b) by 0 days.

(21) Appl. No.: 17/024,190

(22) Filed: Sep. 17, 2020

(51) Int. Cl.

| | |
|---|---|
| ***B05B 3/06*** | (2006.01) |
| ***B05B 3/04*** | (2006.01) |
| ***B05B 15/65*** | (2018.01) |
| ***B05B 3/00*** | (2006.01) |

(52) U.S. Cl.
CPC ..... *B05B 3/063* (2013.01); *B05B 3/008* (2013.01); *B05B 3/0463* (2013.01); *B05B 3/0486* (2013.01); *B05B 15/65* (2018.02)

(58) Field of Classification Search
CPC ..... B05B 3/063; B05B 3/0486; B05B 3/0463; B05B 3/008; B05B 15/65
USPC ..... 239/104, 119, 222.11, 222.17, 222.21, 239/223, 224, 581.1
See application file for complete search history.

(56) References Cited

U.S. PATENT DOCUMENTS

| | | | | |
|---|---|---|---|---|
| 3,955,763 | A | 5/1976 | Pyle et al. | |
| 4,116,386 | A | 9/1978 | Calder | |
| 4,165,836 | A | 8/1979 | Eull | |
| 4,819,872 | A | 4/1989 | Rosenburg | |
| 5,415,348 | A | 5/1995 | Nelson | |
| 6,199,771 | B1 * | 3/2001 | Clearman | B05B 3/0445 239/222.11 |
| 6,254,013 | B1 * | 7/2001 | Clearman | B05B 1/3006 239/222.11 |
| 6,382,525 | B1 * | 5/2002 | Santiesteban | B05B 1/265 239/222.11 |
| 7,677,475 | B2 * | 3/2010 | Lawyer | B05B 1/265 239/222.11 |
| 8,028,932 | B2 * | 10/2011 | Sesser | B05B 3/008 239/222.21 |
| 9,283,577 | B2 | 3/2016 | Nelson | |
| 9,387,494 | B2 | 6/2016 | Sesser | |
| 9,403,177 | B2 | 8/2016 | Sesser | |
| 9,534,619 | B2 * | 1/2017 | Sesser | B05B 15/534 |
| 10,144,029 | B2 | 12/2018 | Lawyer | |

* cited by examiner

*Primary Examiner* — Steven J Ganey
(74) *Attorney, Agent, or Firm* — Scott D. Swanson; Shaver & Swanson, LLP

(57) ABSTRACT

An improved nozzle assembly for use with a sprinkler body. The nozzle assembly has a nozzle body having a recess and defining a fluid flow path through the nozzle assembly. A nozzle insert is positioned in the nozzle body and retained by a keeper tab that is positioned through an opening in a rear wall of the recess. The nozzle insert is rotatable between a series of operational positions including the IN (or insertion) position, the RUN position, the OFF position, the FLUSH position, and the LINE FLUSH position. A biasing plate is positioned on the face of the nozzle body and is configured to detent the turning knob of the nozzle insert in the RUN position. Further provided is a nozzle insert carrier configured to retain additional, not-in-use nozzle inserts with the nozzle assembly.

19 Claims, 45 Drawing Sheets

NOZZLE ASSEMBLY WITH ROTATING NOZZLE INSERT

TECHNICAL FIELD

The presently disclosed technology relates to a nozzle and nozzle body for use with an irrigation sprinkler. More particularly, the present invention is a nozzle body having a removable nozzle insert configured to rotate to a plurality of operating positions within the nozzle body.

BACKGROUND

Agricultural irrigation systems typically utilize a main distribution line, such as a center pivot, that leads to a series of individual distribution lines that utilize one or more sprinklers. A variety of sprinklers exist that serve to distribute the irrigation water in a variety of ways, with a common mechanism being to spray fluid from a nozzle or nozzle-like structure onto a distribution plate or disc. Irrigation water delivered by these systems is often delivered by canal or taken directly from a natural source. The irrigation water can have dirt or other debris in the material that can lead to clogging of the sprinkler nozzles and/or valves leading to the sprinklers. Accordingly what is needed is an improved nozzle and/or sprinkler that allows for flushing of the nozzle, facilitates simple replacement of the nozzle with varying nozzle sizes, and provides for flushing of the line above the nozzle without requiring detachment of the sprinkler from the irrigation line.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a nozzle assembly having a side loading nozzle. The nozzle assembly has a nozzle body comprising a flow passage along a longitudinal flow axis of the nozzle body. The flow passage extends from a fluid input at the first end of the nozzle body and extends through the nozzle body to a fluid output at the second end of the nozzle body. The nozzle body has a forward face and defines a nozzle body recess formed in the nozzle body and extends inward from the forward face. The nozzle body recess extends into the nozzle body and intersects the flow passage in a generally perpendicular orientation to the flow passage. The nozzle body recess is defined by a substantially cylindrical wall within the nozzle body and an end wall. The nozzle body recess end wall is a ring shape having a flange extending inward from the substantially cylindrical wall and defining a generally circular opening and a keeper tab notch in the flange. The nozzle body recess rear wall has an inner surface and an outer surface, with the inner surface forming an end to the nozzle insert wall.

The nozzle assembly includes a nozzle insert removably positioned within the recess in the nozzle body. The nozzle insert has an elongated insert body having an insert axis about which the nozzle insert rotates within the insert body. The nozzle insert is rotatable in the nozzle body recess to plural operating positions, including the IN, RUN, FLUSH, OFF, and LINE FLUSH positions. While these terms are preferred, alternate terms can be utilized without deviating from the scope of the invention. The nozzle insert has a forward end face having a turning knob. The turning knob has a rounded end extending beyond an outer edge of the forward end face.

A nozzle bore extends through the insert body on an axis intersecting the insert axis. The nozzle bore has a first end (inflow orifice) and a second end (outflow orifice) and is configured to restrict fluid flow therethrough from the first end to the second end. The nozzle bore is configured to align with the flow passage of the nozzle body to provide a continuous fluid passage.

The nozzle insert has a rear end face and a rearwardly-projecting annular ring extending from the rear end face. The annular ring is of smaller diameter than the rearward end face. The annular ring has a keeper tab extending from the outer surface of the annular ring. When the nozzle insert is inserted into the nozzle body recess in the IN position, the annular ring is configured to pass through the generally circular opening of the nozzle body recess end wall and the keeper tab through the keeper tab notch of the nozzle body recess end wall. Preferably the nozzle body has two or more ribs positioned within the nozzle body recess and configured to work with the radial ramps on the end face of the nozzle insert to bias the nozzle against a nozzle seal positioned between the nozzle insert and the nozzle body.

The keeper tab is configured with a space between an inner surface of the keeper tab and the rear face of the nozzle insert. This space is configured such that the rear wall of the nozzle body recess is positioned between the keeper tab and the rear face of the nozzle insert in each operating position beyond the IN position and as the nozzle insert rotates between positions. The positioning of the rear wall of the nozzle body recess between the keeper tab and the rear face of the nozzle body retains the nozzle insert in the nozzle body recess during use of the nozzle assembly and a downstream sprinkler. Preferably the outer surface of the end wall of the nozzle body recess has a stop tab positioned thereon. The stop tab is preferably adjacent to the keeper tab notch and stops rotation of the keeper tab at an operating position. In the figures this operating position is the LINE FLUSH position.

A biasing plate is attached to the forward face of the nozzle body. The biasing plate has a detent notch and a push tab located proximate to the detent notch. The biasing plate is biased outward from the forward face of the nozzle body such that when the rounded end of the turning knob of the nozzle insert aligns with the detent notch the biasing tab is configured to bias away from the face to provide a detent to the rounded end of the turning knob of the nozzle insert. The detent notch in the biasing plate serves to ensure the nozzle bore is aligned with the flow path of the nozzle body. In this position the nozzle bore is oriented such that fluid flows through the nozzle from the first end of the nozzle bore to the second end of the nozzle bore when the rounded end of the turning knob of the nozzle insert is held in detent by the detent notch of the biasing plate.

Depression of the push tab biases the biasing plate toward the face of the nozzle body to release the detent of the detent notch on the rounded end of the turning knob of the nozzle insert. Releasing of the detent allows the nozzle insert to rotate clockwise or counterclockwise to a further operating position.

In a preferred embodiment the substantially cylindrical wall defining the nozzle body recess extends beyond the rear wall defining the rear of the nozzle body recess. This wall forms a cylindrical wall around the annular ring of rear end of the nozzle insert. The substantially cylindrical wall is configured for attachment to an end mount. The end mount in a preferred embodiment can be a cap to keep the area within the circular wall free of debris, or alternatively a mount for a nozzle insert carrier. Preferably the attachment configuration includes a series of openings on one of the cylindrical wall and the end mount and a series of tabs on the other of the cylindrical wall and the end mount, such that the tabs and opening are configured for mating engagement to secure the end mount to the cylindrical wall.

The nozzle assembly is preferably configured for releasable attachment to a sprinkler body or can be constructed integral with a sprinkler body. The sprinkler body is utilized to distribute fluid sprayed typically on a distribution disk or alternate sprinkler fluid distribution mechanism.

Preferably the nozzle insert is a substantially cylindrical shape having a channel formed on the exterior wall of the nozzle insert. The channel is configured to direct fluid flow from nozzle first end out an opening in the side of the nozzle body.

The nozzle assembly can further include a weight. The weight is preferably configured to fit over said nozzle body to dampen vibration from the sprinkler and to prevent the nozzle assembly and sprinkler hitting another sprinkler from blowing in the wind.

The nozzle assembly in preferred embodiments utilizes a nozzle seal positioned between the inflow port of the nozzle body and the nozzle insert. The nozzle seal is retained in place by a nozzle seal carrier, which in turn is retained by the connection of a threaded adapter at the first end of the nozzle body. The nozzle seal preferably is in a concave shape and has at least one positioning tab, and preferably two positioning tabs with one on opposing sides of the nozzle seal. The positioning tabs are positioned within locating grooves of the nozzle body to locate the nozzle seal in the correct position when the nozzle seal is positioned within the nozzle body.

In a further embodiment the nozzle includes a nozzle insert carrier, which as described above can be one of the end mounts to carry alternate sized nozzle inserts and/or replacement nozzle inserts. The nozzle insert carrier is configured to retain nozzle inserts utilizing the same mechanism as used to retain the nozzle inserts in the end wall of the nozzle body recess. The rearwardly projecting annular ring of the nozzle insert is configured to extend through an opening in a bottom wall of a cylindrical nozzle insert carrier. The end wall of the cylindrical nozzle insert carrier has a keeper tab notch configured for receiving of the keeper tab of the annular projection of the nozzle insert. Insertion of the nozzle insert into the nozzle insert carrier such that the annular ring of the rear of the nozzle insert and keeper tab extend through the opening in the nozzle insert carrier, followed by rotation of the nozzle insert, serves to lock or retain the nozzle insert in the nozzle insert carrier.

Preferably two nozzle insert carriers are adjoined, preferably by a bridge. The nozzle insert carriers are configured to attach to the nozzle body. Preferably the nozzle insert carriers are configured to attach to the rear of the nozzle body at the cylindrical wall, via the tabs and openings discussed above. Preferably a cylindrical wall called a mounting cap extends from the nozzle insert carriers, more preferably from a bridge adjoining two nozzle insert carriers. The mounting cap is configured to cap the cylindrical wall extending from the rear of the nozzle body.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature

DETAILED DESCRIPTION OF THE FIGURES

Figure 1:
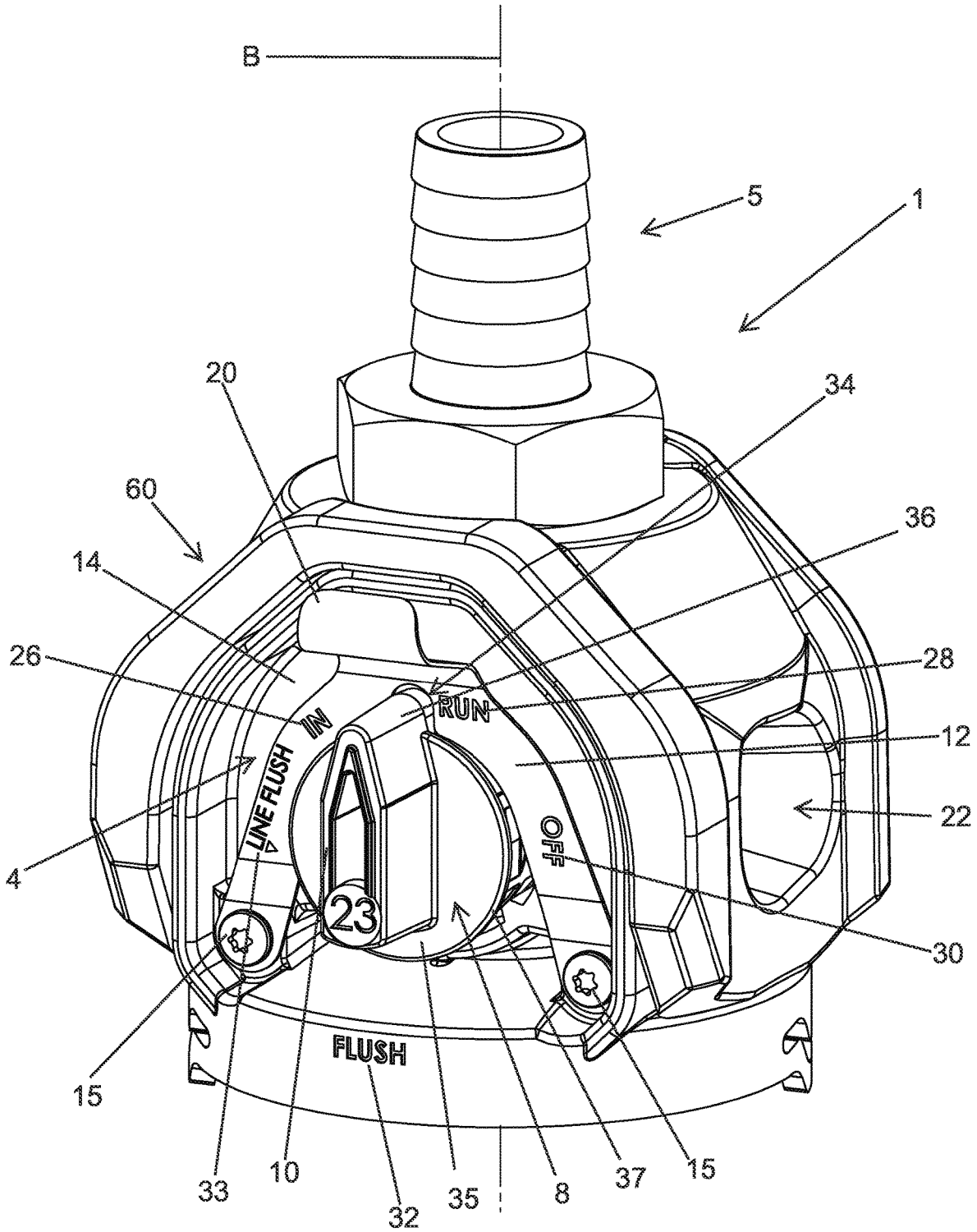
FIG. 1 illustrates a perspective view of a preferred embodiment of a nozzle assembly having a nozzle body having a nozzle insert positioned therein in the RUN position, a weight, a cap, and an adapter.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a perspective view of a nozzle assembly 1 having a nozzle body 4, nozzle insert 8, weight 60 and adapter 5. The adapter 5 is provided for connecting the inlet of the nozzle body to an irrigation water source, such as a center-pivot irrigation line (not shown).

The nozzle body 4 has an inlet channel 16 and outlet channel 18 generally provided along a longitudinal flow axis B of the nozzle body. Between the inlet and the outlet of the nozzle body is a recess 6 into which the nozzle insert 8 is positioned. The nozzle insert is formed as a substantially cylindrical body, referred to as the insert body. The insert body has a longitudinal center axis, or axis of rotation, depicted as axis A. This axis of rotation is perpendicular to the longitudinal flow axis B of the nozzle body. The nozzle insert has a nozzle bore (illustrated in subsequent figures) extending through the nozzle insert in a generally perpendicular orientation to the axis of rotation of the insert body. The nozzle bore has an inlet end (inlet orifice) and an outlet end (outlet orifice) configured for fluid flow therethrough. As shown in subsequent drawings, the inlet end is larger than the outlet end, with the nozzle bore narrowing as it extends from the inlet end to the outlet end to constrict fluid flow through the nozzle bore such that the nozzle bore functions as a nozzle when the nozzle insert is positioned in the nozzle body in the RUN position.

The nozzle insert has a turning knob 10 to facilitate rotation of the nozzle insert between operating positions. The turning knob has a rounded end 36 that extends beyond the circumference 37 of the forward end face 35 of the cylinder forming the insert body. In the depicted embodiment, the nozzle insert 8 is rotatable on its longitudinal axis through a series of positions including IN 26, RUN 28, OFF 30, FLUSH 32, and LINE FLUSH 33 positions. In the different positions the nozzle body is positioned at a different orientation relative to the inlet channel 16 and outlet channel 18 of the nozzle body. In the RUN position, the nozzle bore is aligned with the inlet channel 16 and outlet channel 18 of the nozzle body to serve as a nozzle constricting flow through the nozzle body. In the FLUSH position, the nozzle insert is rotated 180 degrees such that the nozzle bore is oriented with the outlet end receiving fluid flow from inlet channel 16 of the nozzle body and the inlet end of the nozzle insert aligned with the outlet channel 18 of the nozzle body.

The nozzle body has a forward face 14 through which the recess in the nozzle body is formed. Attached to the forward face of the nozzle body is a biasing plate 12. In the depicted embodiment the biasing plate is attached to the nozzle body by two screws 15. The biasing plate is positioned generally around the nozzle body recess thus having an opening configured for acceptance of the nozzle insert through the opening and into the recess in the nozzle body. The biasing plate has detent notch 34 extending from the opening in the biasing plate. When the nozzle is in the RUN position, the rounded end 36 of the turning knob 10 is positioned within the detent notch of the biasing plate. The notch in combination with the biasing plate serves as a detent to prevent rotation of the nozzle insert in either direction from the RUN position. In order to rotate the nozzle insert from the RUN position, the push tab 20 of the biasing plate must be moved toward the forward face 14 of the nozzle body to release the detent on the rounded end of the turning knob.

The biasing plate in the depicted embodiment has indicators 26, 28, 30, 32, 33 representing the IN, RUN, OFF, FLUSH and LINE FLUSH positions of the nozzle insert relative to the nozzle body. In the depicted embodiment the nozzle body is further configured having a connection mechanism 68 to connect the nozzle body to a sprinkler body to provide for fluid distribution.

Figure 2:
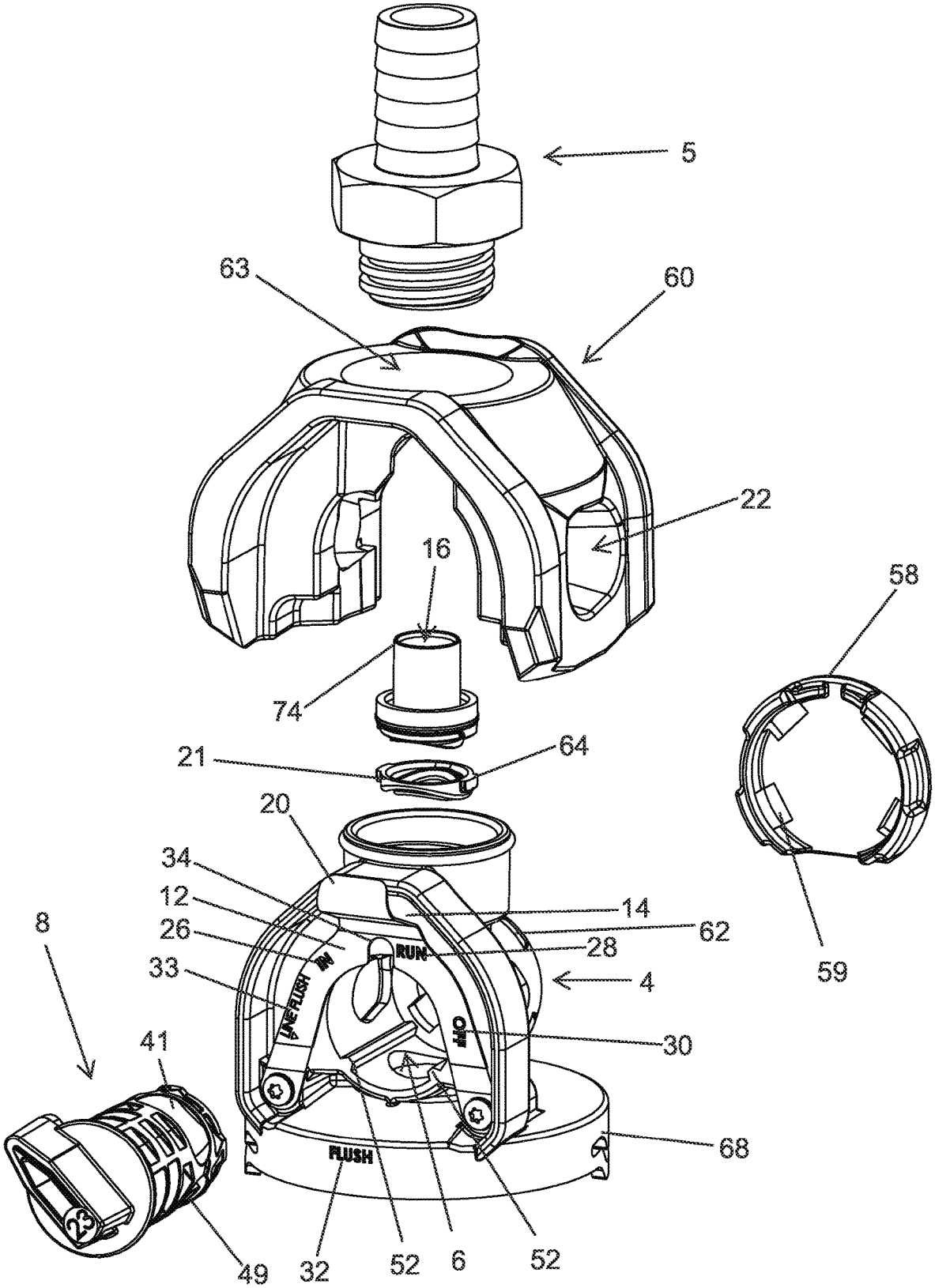
FIG. 2 illustrates an exploded view of the nozzle assembly of FIG. 1 with the nozzle insert in the IN position.

FIG. 2 illustrates an exploded view of the nozzle assembly of FIG. 1. FIG. 2 illustrates the nozzle insert 8 removed from the nozzle body recess 6. The adapter 5 is removed from the nozzle body. The weight 60 is shown having an opening 63 configured for placement of the weight on the nozzle body. A seal carrier 74 is shown at the inflow port of the nozzle body. The seal carrier 74 serves to retain a seal 21 in the nozzle body. The seal serves to provide a seal between the inflow of the nozzle body and the nozzle insert. The seal is formed in a generally convex shape to form to the shape of the cylindrical nozzle insert. The seal has two locating tabs 64 that are positioned within locating notches in the nozzle body. The seal is further formed with two lips, one for seating against a lip in the nozzle body and the other against the nozzle insert to provide a fluid tight flow path through the nozzle assembly.

The nozzle body recess 6 is shown with two ribs 52 configured to work with the radial ramps (illustrated for example in FIG. 7) of the end face of the nozzle insert to bias the nozzle against the seal. The weight is configured with an opening 22 to allow for fluid flow there through in the LINE FLUSH orientation. The nozzle assembly further includes a cap 58 having a plurality of openings 59 configured for making engagement with a series of tabs 62 in a rear extension of the nozzle body. The nozzle cap serves to protect and keep free of debris the rear of the nozzle body and keeper tab of the nozzle insert that rotates around the rear of the nozzle body, as shown in further detail in FIG. 4.

Figure 3:
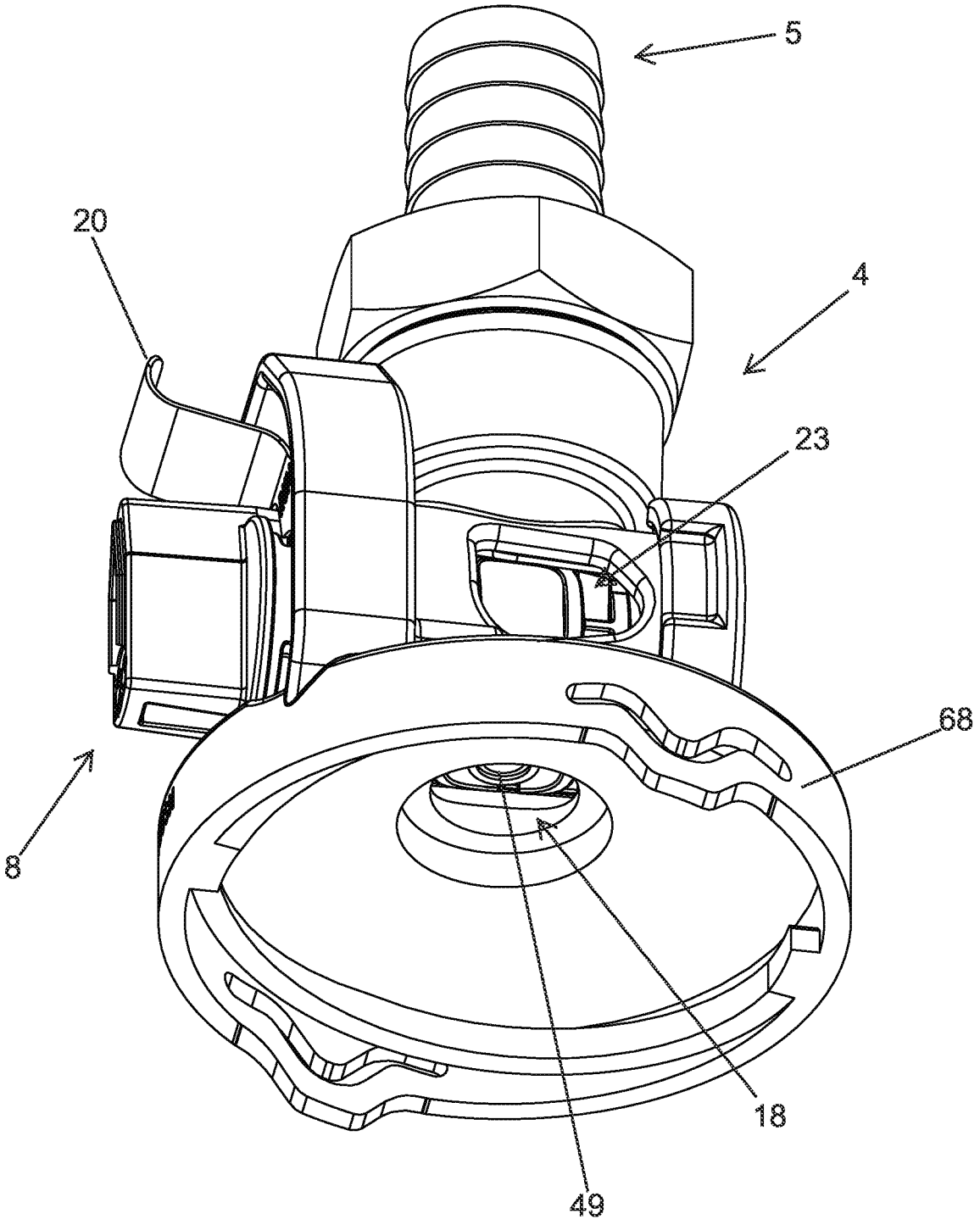
FIG. 3 illustrates a bottom perspective view of the nozzle assembly of FIG. 1 having the weight removed and the nozzle assembly in the RUN position.

FIG. 3 illustrates a bottom perspective view of the nozzle body and adapter 5 of FIG. 1. The nozzle body has an outlet channel 18. The outlet channel is aligned with the longitudinal flow axis B of the nozzle body. Fluid enters the nozzle body via adapter 5, flows through the nozzle insert when the nozzle insert is in the RUN position, and out the outflow orifice 49 of the nozzle insert. In the depicted embodiment the nozzle body includes a connector 68 for connecting to a sprinkler body. The sprinkler body is configured to distribute irrigation water sprayed into the sprinkler body. One example is the distribution is achieved utilizing a rotating distribution disc, although any type of sprinkler distribution system can be utilized that can be connected to the nozzle body. A variety of connections can be utilized between the nozzle body and the sprinkler body. Varying connection types are illustrated, for example, at FIGS. 30-36.

Figure 4:
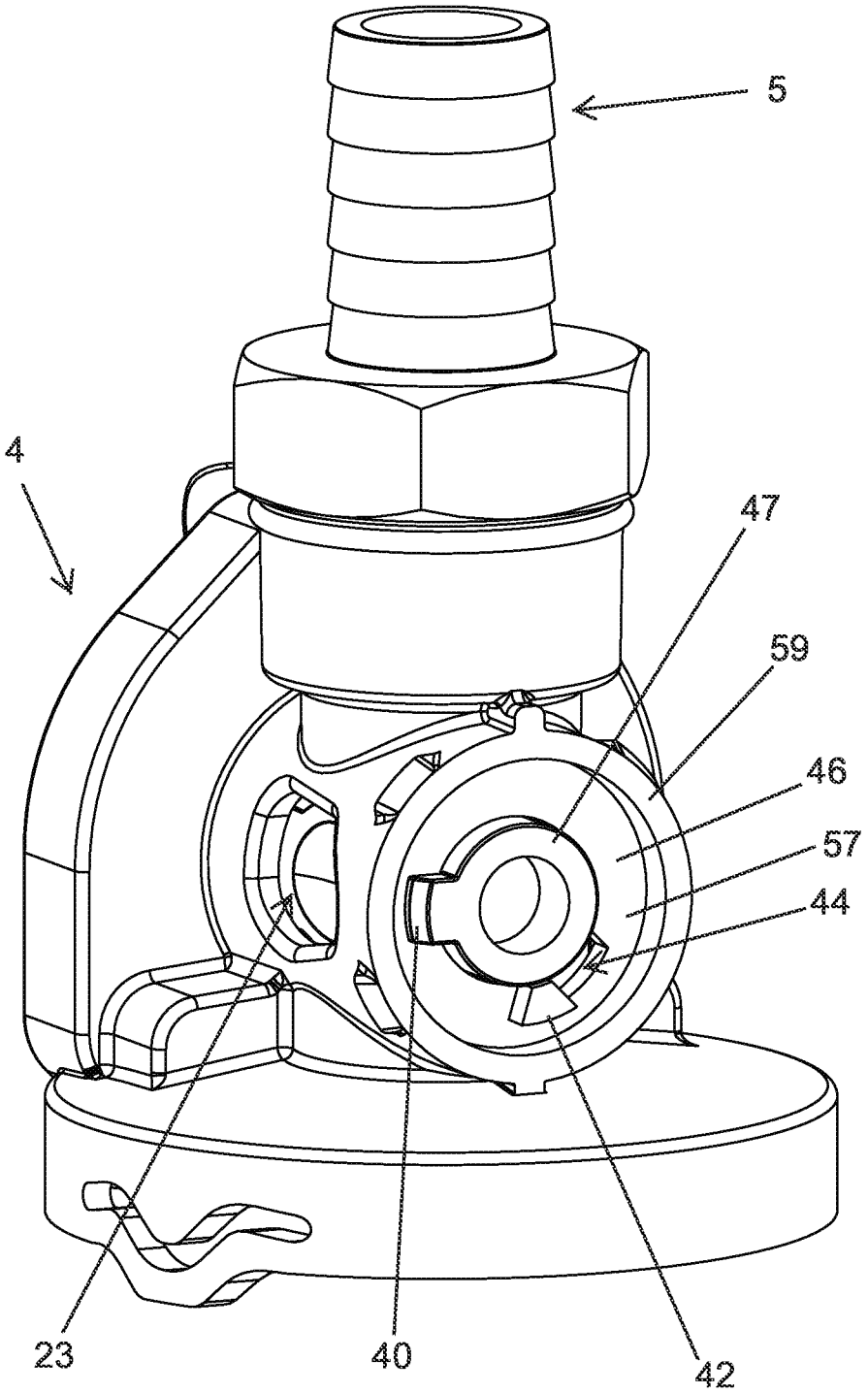
FIG. 4 illustrates a rear perspective view of the nozzle assembly of FIG. 1 having the nozzle body housing removed with the nozzle insert in the FLUSH position.

FIG. 4 illustrates a rear perspective view of the nozzle body and adapter 5. The nozzle body 4 has a rear wall 46 that forms the rear wall of the recess in the nozzle body for the nozzle insert. The rear wall 46 is configured in a disc shape. The disc shape has a keeper tab notch 44 extending into the disc. The keeper tab notch is configured in a shape to allow for the keeper tab 40 to be placed through the keeper tab notch 44. An undersurface of the keeper tab notch 44 rotates along the outer surface of the rear wall 46 of the nozzle body recess as the nozzle insert rotates through the operating positions. The nozzle insert has an annular ring 47 rearwardly projecting from the rear face of the nozzle insert. The annular ring is configured to extend through the opening in the disc shaped rear wall 46. The keeper tab extends from the annular ring. The disc shaped rear wall further utilizes a stop tab 42 that extends from the disc shaped rear wall away from the nozzle body. The stop tab is configured to stop or arrest rotation of the nozzle insert by blocking rotation on the keeper tab 40 when the keeper tab 40 reaches the stop tab 42.

Further illustrated in FIG. 4 is a flush opening 23 in the nozzle body. In the depicted embodiment, when the keeper tab 40 of nozzle insert is positioned against the stop tab 42 of the rear wall of the nozzle body the nozzle insert is in the LINE FLUSH position. In the LINE FLUSH position, the flush channel 39 of the nozzle insert is positioned such that fluid flowing from the inlet channel 16 is directed through the flush channel and out the flush opening in the body.

Figure 5:
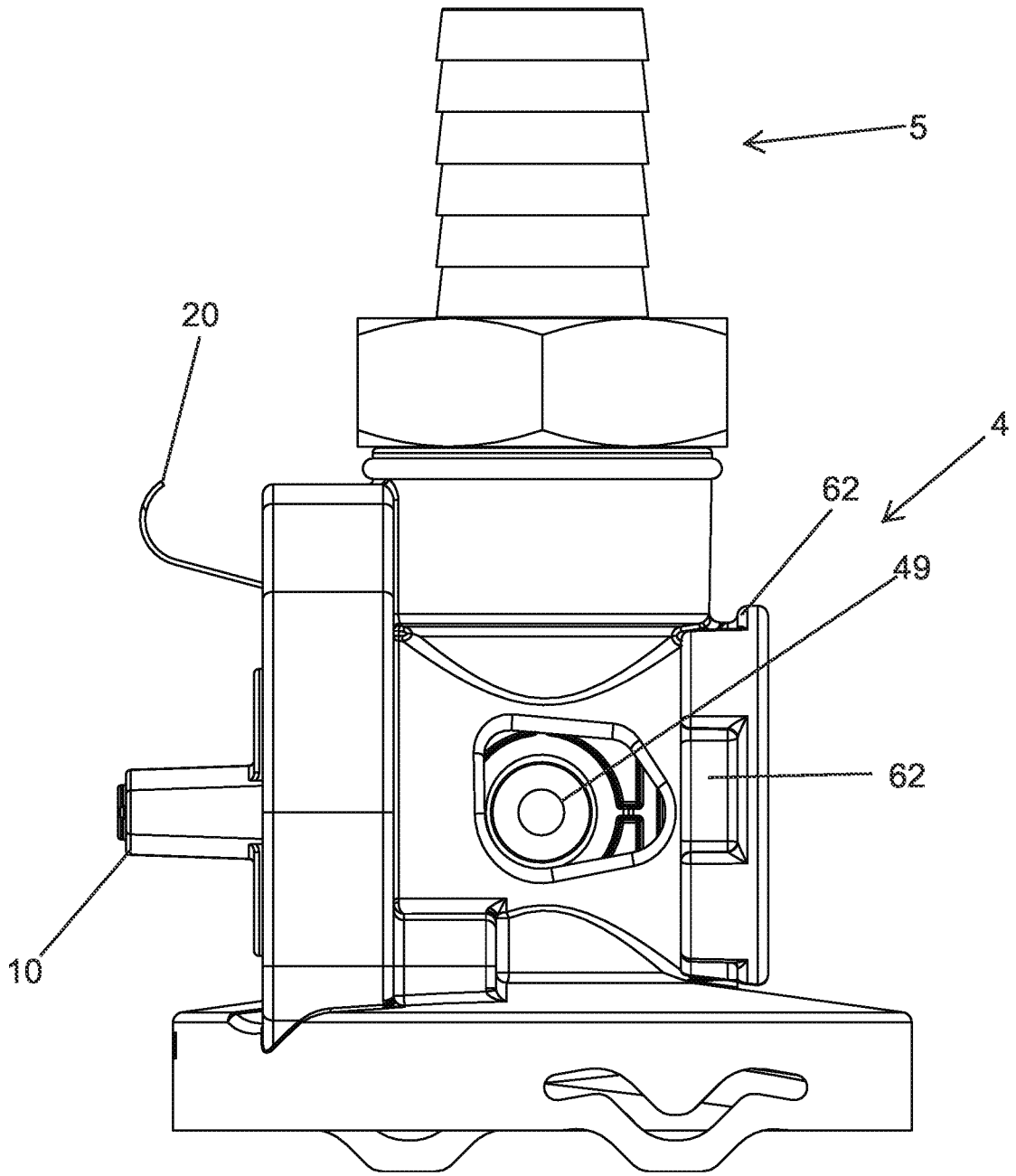
FIG. 5 illustrates a side view of the nozzle assembly of FIG. 1 having the weight removed with the nozzle insert in the OFF position.

FIG. 5 illustrates a side view of the nozzle body and adapter 5. The nozzle insert is positioned such that the turning knob is in the OFF position. The stop depression 41 (shown in FIG. 7) of the nozzle insert is positioned facing the nozzle body first end and the seal of the nozzle body is positioned around the stop depression. Flow from the inflow port of the nozzle body is blocked by the seal and the depression of the nozzle insert. In the stop position the nozzle insert 4 is positioned generally perpendicular to the flow path from the inlet channel from the nozzle body through the outlet channel of the nozzle body. Positioning of the nozzle insert in the OFF position prevents fluid flow through the nozzle body.

Figure 6:
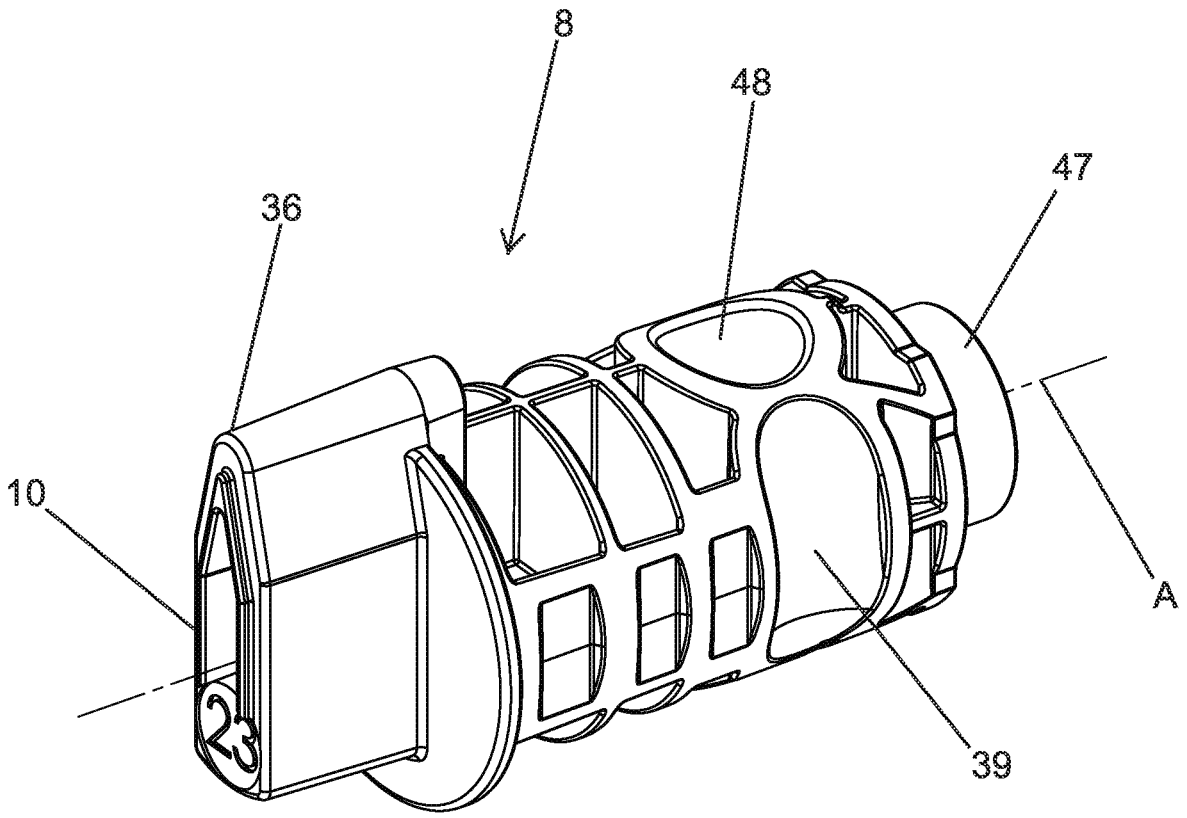
FIG. 6 illustrates a perspective view of a nozzle insert.
Figure 7:
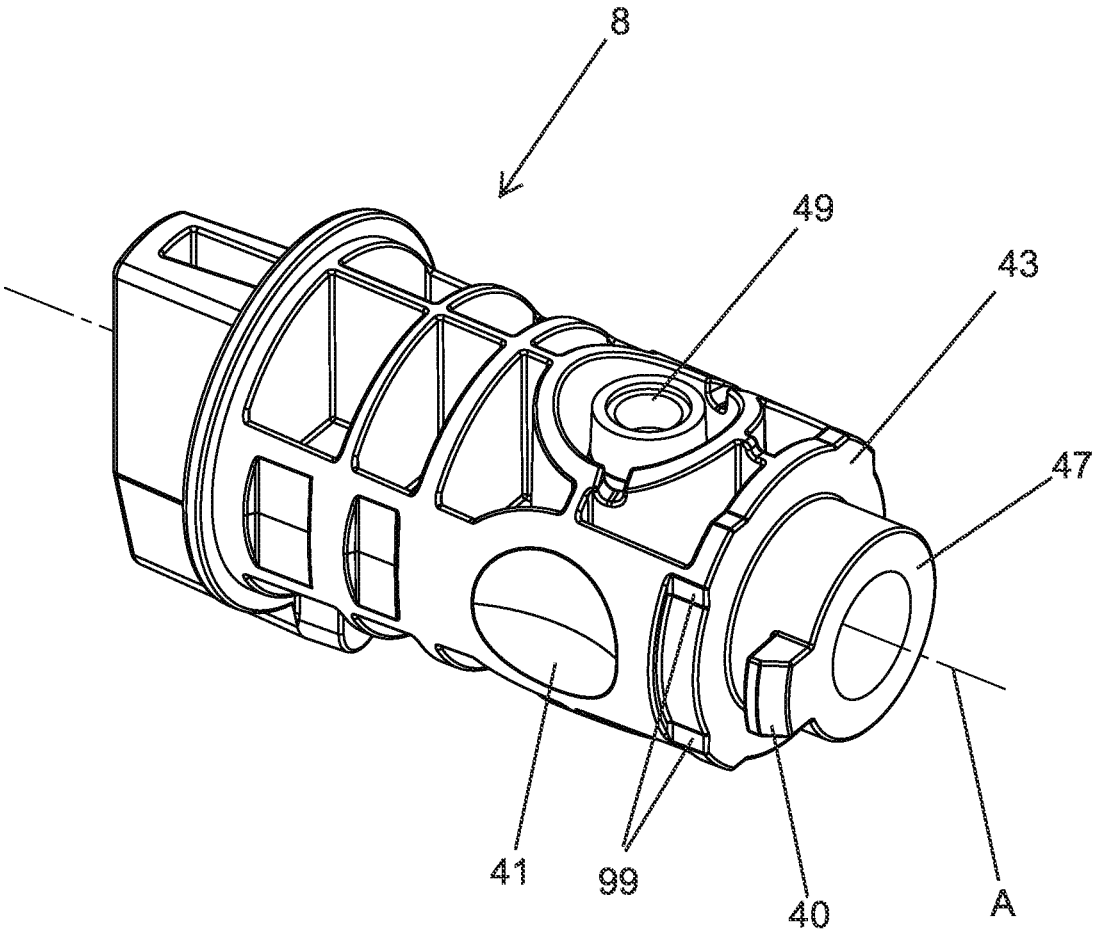
FIG. 7 illustrates a perspective view of the nozzle insert of FIG. 6 rotated 180 degrees.

FIGS. 6 and 7 illustrate perspective views of the nozzle insert. FIG. 6 illustrates a perspective view of the top and rear portions of the nozzle insert in the upward or RUN position. The longitudinal center axis A of the nozzle insert is further illustrated. The nozzle insert has an inflow orifice 48 of the nozzle passageway. The nozzle passageway has a constricting flow path leading to the outflow orifice 49. The stop depression 41 coupled with the seal 21 of the nozzle body serves to block fluid flow through the sprinkler body when the nozzle insert is in the OFF position. In the LINE FLUSH position channel 39 is positioned in an orientation to the nozzle body inflow to deflect or direct fluid out of the flush opening in the nozzle body.

FIG. 7 illustrates a perspective view of the bottom of the nozzle insert. FIG. 7 provides further illustration of the rear structure of the nozzle insert including the annular ring 47 and keeper tab 40. The annular ring extends from the rear face of the nozzle insert. Further illustrated is the keeper tab 40 extending from the generally annular ring 47 of the rear face 43 of the nozzle insert. The spacing between the rear face of the nozzle insert and the keeper tab on the insert extension provides a space that is configured such that the rear wall of the nozzle body is positioned within this space when the nozzle insert is operationally position within the recess of the nozzle body. The inner surface of the keeper tab rotates along the outer surface of the rear wall of the nozzle body recess while the surface of the rear face of the nozzle insert rotates along the inner surface of the rear wall of the nozzle body, effectively securing the nozzle insert in the recess of the nozzle body. The nozzle insert is released by rotating the nozzle insert back to the IN position until the keeper tab is aligned with the keeper tab notch of the rear wall of the nozzle body recess, at which position the nozzle insert can be removed from the nozzle body recess.

Figure 8:
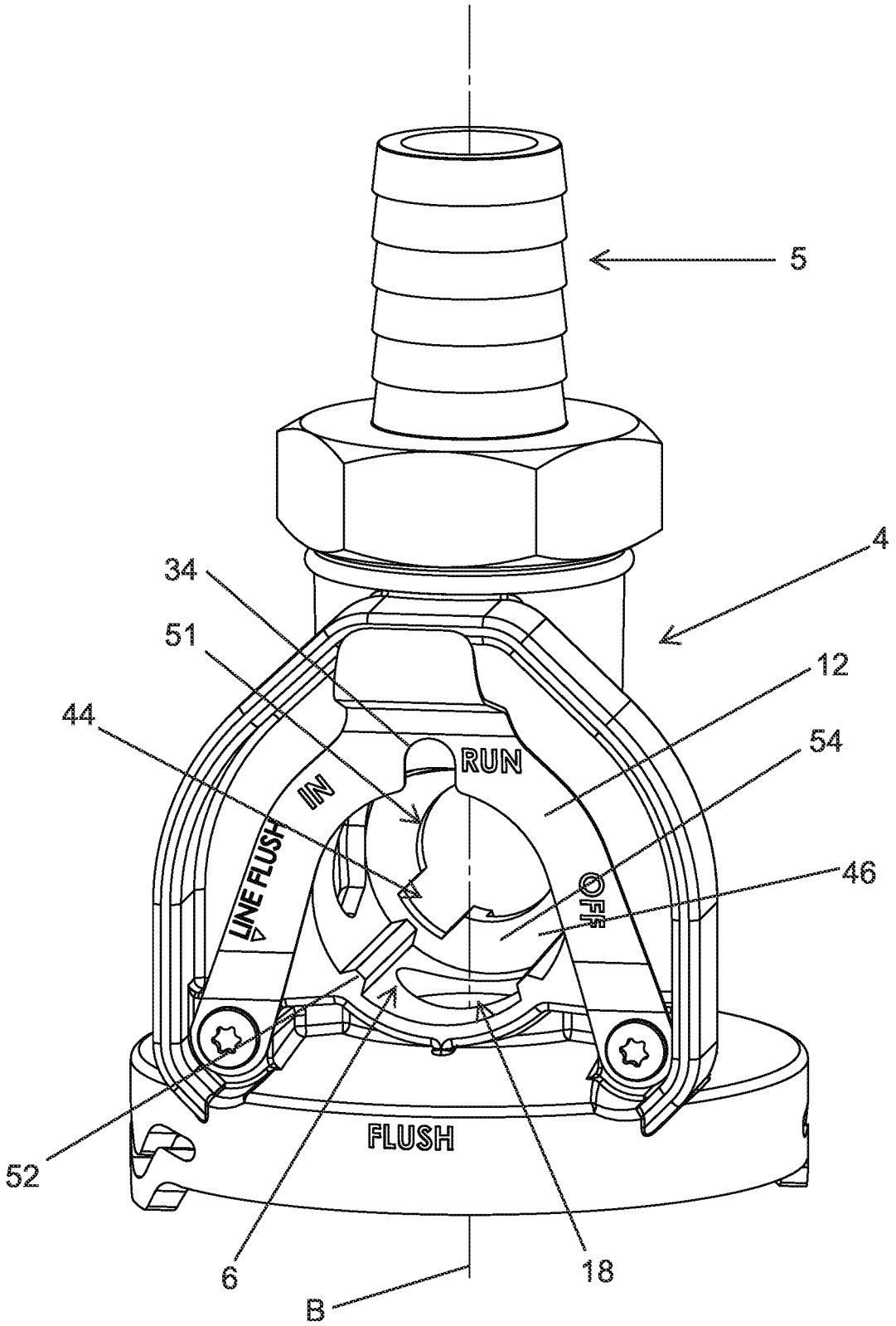
FIG. 8 illustrates a front perspective view of a nozzle body and adapter.

FIG. 8 illustrates a front perspective view of a nozzle body 4 and adapter 5. The nozzle insert has been removed from the nozzle body illustrating the internal components of the nozzle body recess. The longitudinal flow axis B of the nozzle body is further illustrated. FIG. 8 illustrates the circular opening 51 in the rear wall of the recess in the nozzle body. The inner surface 54 of the rear wall is further illustrated. The keeper tab notch 44 is positioned in the disc like structure of the rear wall. The outlet channel of the nozzle body is further illustrated.

Figure 9:
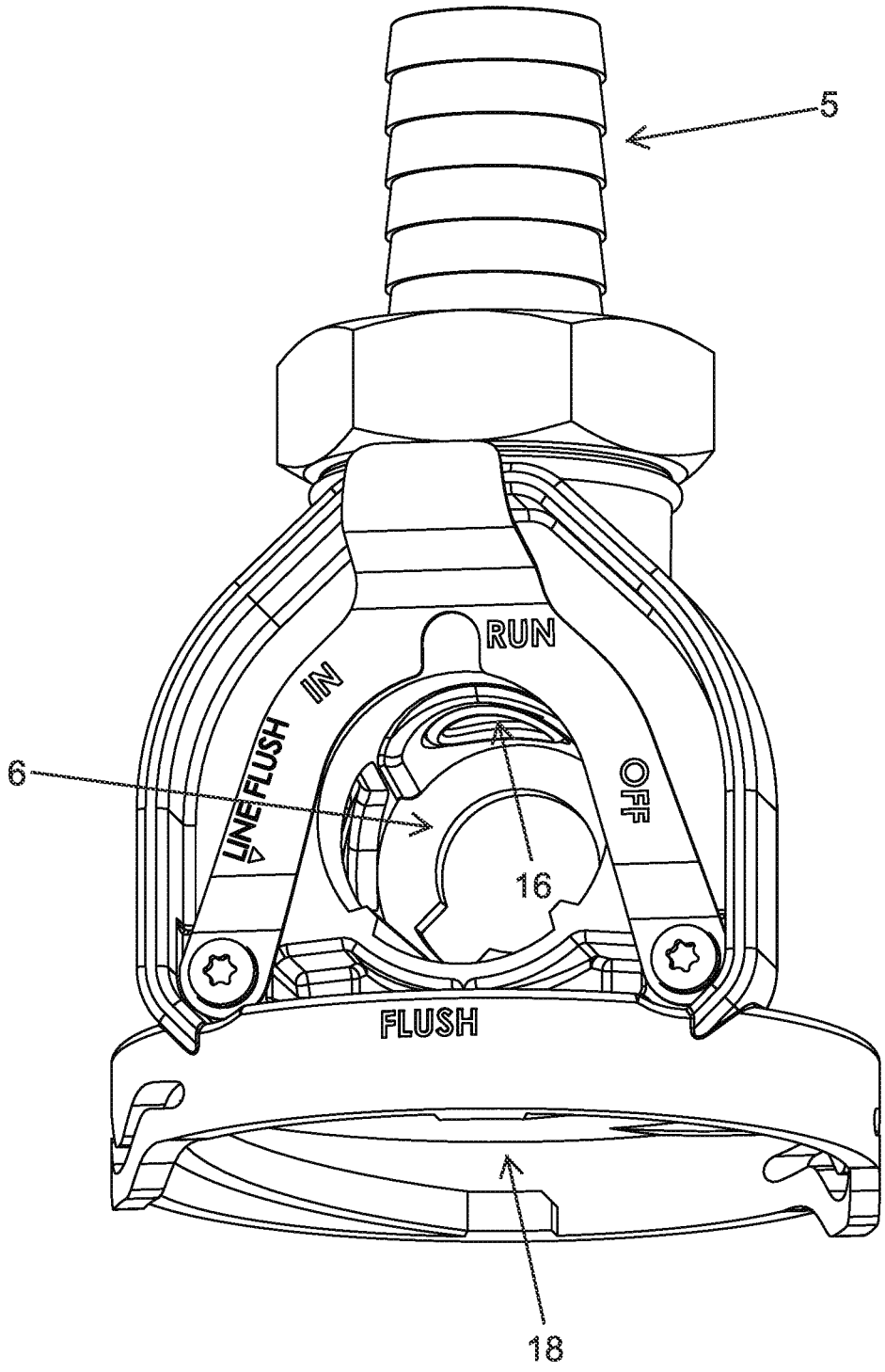
FIG. 9 illustrates a second front perspective view of a nozzle body and adapter

FIG. 9 illustrates a front perspective view of the nozzle body and adapter having the nozzle insert removed. FIG. 9 provides a view of the upper portion of the nozzle body recess. The nozzle body inlet channel 16 provides a fluid flow port to the nozzle insert. Fluid flows through the nozzle insert and out the nozzle body outlet channel 18 onto a sprinkler distribution device that is a part of a sprinkler body.

Figure 10:
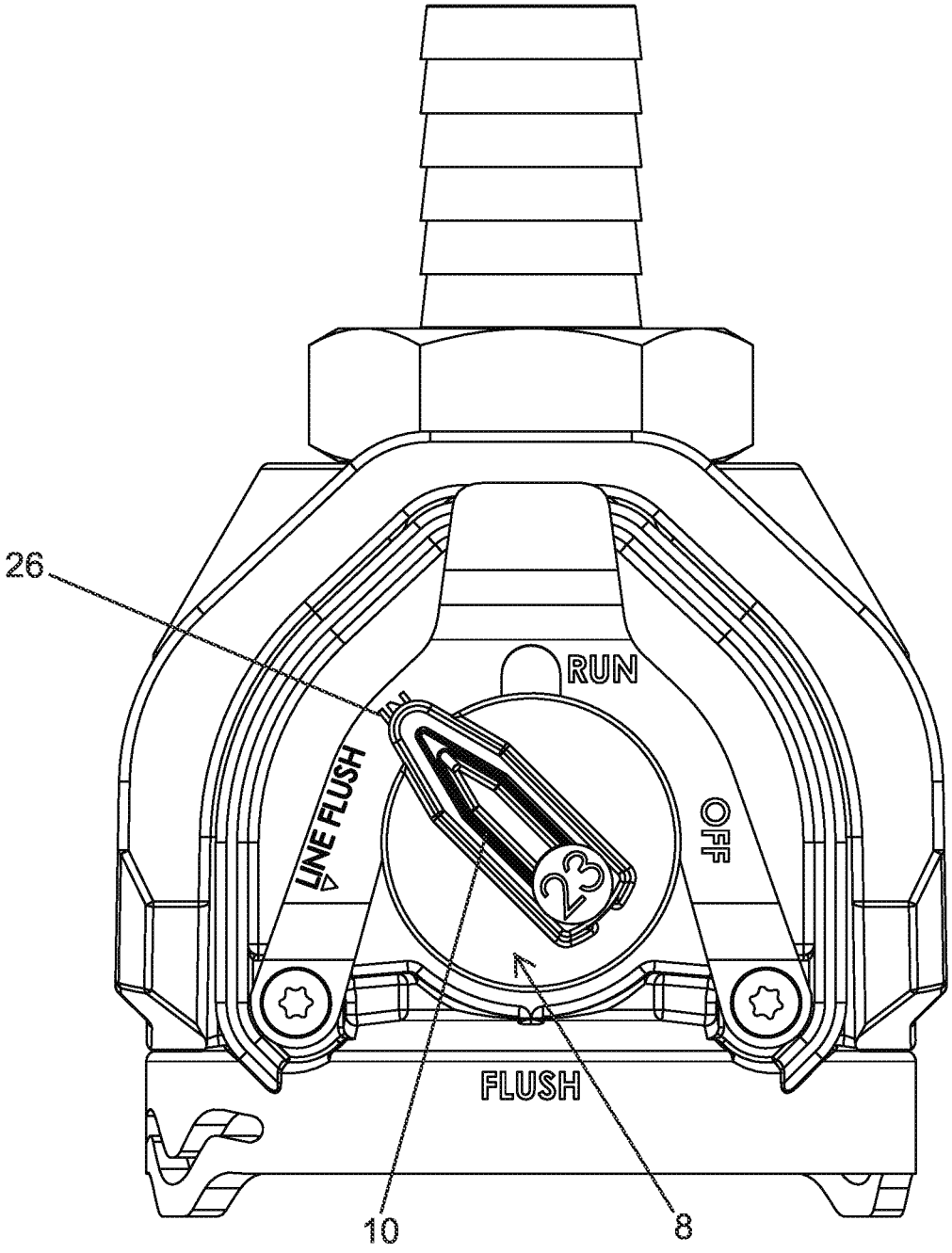
FIG. 10 illustrates a front view of a nozzle assembly with the nozzle insert in the IN position.

FIG. 10 illustrates a front view of the nozzle assembly having the insert, nozzle body, weight, and nozzle insert position within the nozzle body recess in the in position. The turning knob 10 of the nozzle insert 8 is positioned such that the rounded end of the turning knob is pointed at the IN position on the biasing plate. In this position the nozzle insert is inserted into the recess in the nozzle body.

Figure 11:
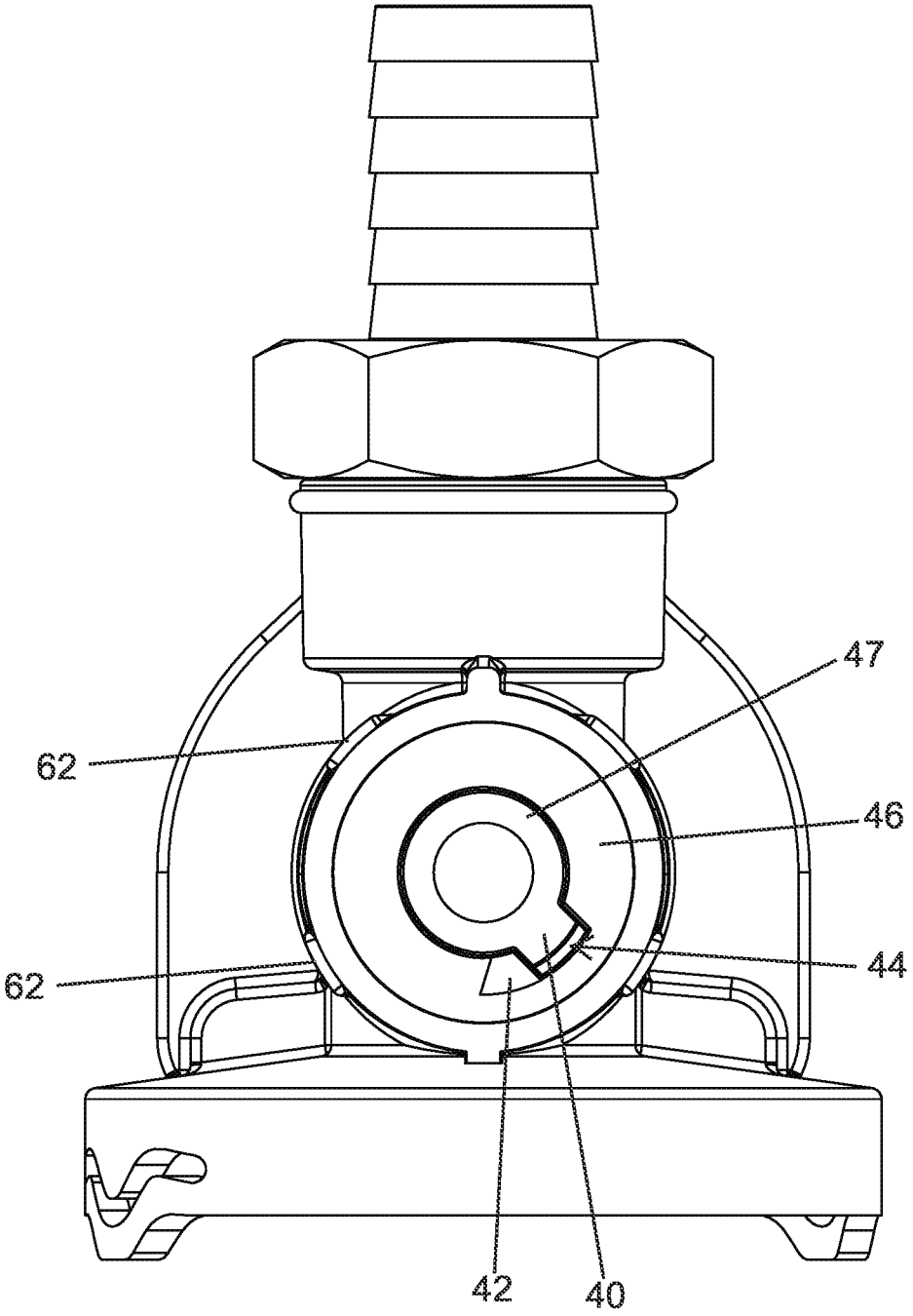
FIG. 11 illustrates a rear view of a nozzle assembly with the nozzle insert in the IN position.

FIG. 11 depicts a rear view of the nozzle assembly in which the nozzle insert is being positioned through the recess in the nozzle body such that the keeper tab 40 travels through the keeper tab notch 44 in the disc shaped rear wall 46 of the nozzle body recess. The annular ring 47 at the rear of the nozzle insert is extending through the circular opening in the rear wall of the nozzle body recess. When the nozzle body annular ring is positioned sufficiently through the opening in the rear wall of the nozzle body recess, the turning knob can then be rotated toward the RUN position. This rotation positions the flange of the rear wall 46 of the nozzle body recess 6 into the gap between the keeper tab 40 and the rear face 43 of the nozzle insert. This positioning secures the nozzle insert in the nozzle body recess.

Figure 12:
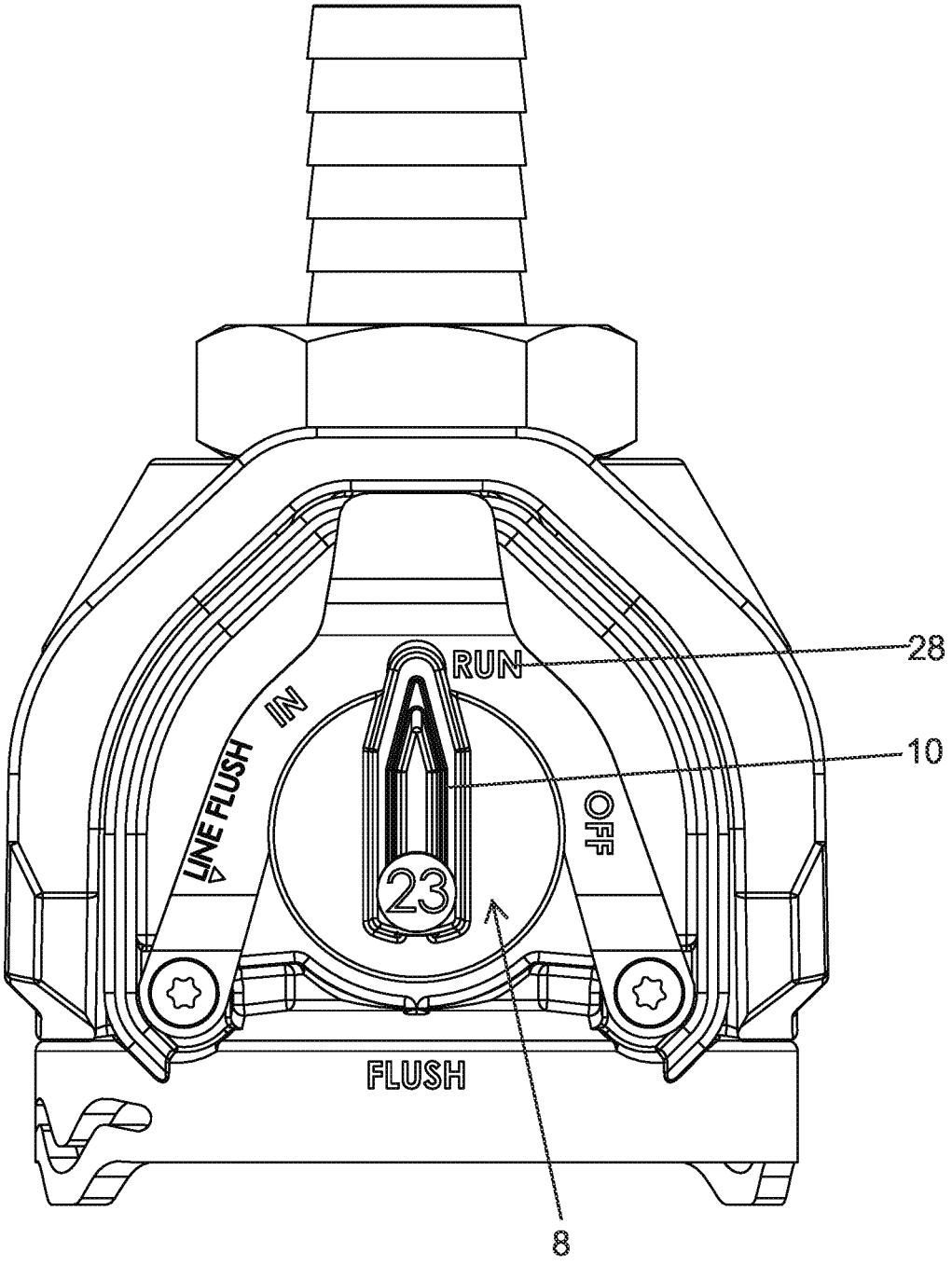
FIG. 12 illustrates a front view of a nozzle assembly with the nozzle insert in the RUN position.

FIG. 12 further illustrates the rounded end of the turning knob positioned within the detent of the biasing notch. The turning knob is positioned so that it is pointed at the RUN symbol. The biasing plate has biased outward around the rounded end of the turning knob to detent rotation of the knob toward either the IN or OFF positions. In the RUN position, the nozzle insert is positioned to operate to allow fluid flow therethrough.

Figure 13:
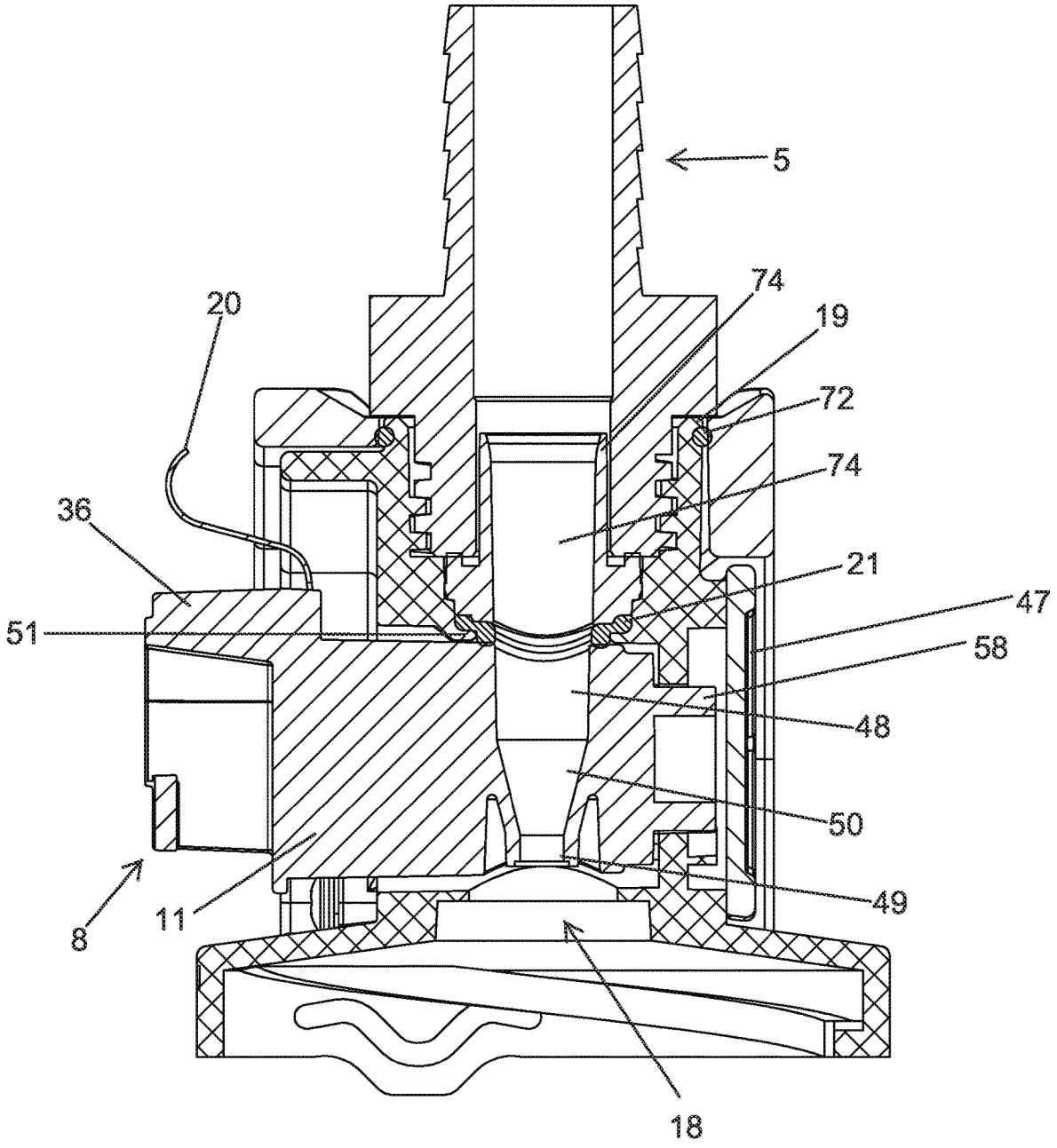
FIG. 13 illustrates a section view of a nozzle assembly with the nozzle insert in the RUN position.

FIG. 13 depicts a section view of the nozzle insert positioned within the nozzle recess in the ON position. The adapter is connected to the nozzle body by threaded engagement. In operation, fluid flows from the adapter 5 through the seal carrier 74, through the nozzle inflow orifice, into the constricting tube 50 and out the nozzle outflow orifice 49. The fluid is sprayed out of the nozzle insert and through the nozzle body outlet channel 18 toward a sprinkler distribution mechanism. The push tab 20 has been biased outward as the biasing notch in a detent position on the rounded end 36 of the turning knob, preventing further rotation of the nozzle insert without releasing the detent. The nozzle insert 11 extends through the recess in the nozzle body.

Figure 14:
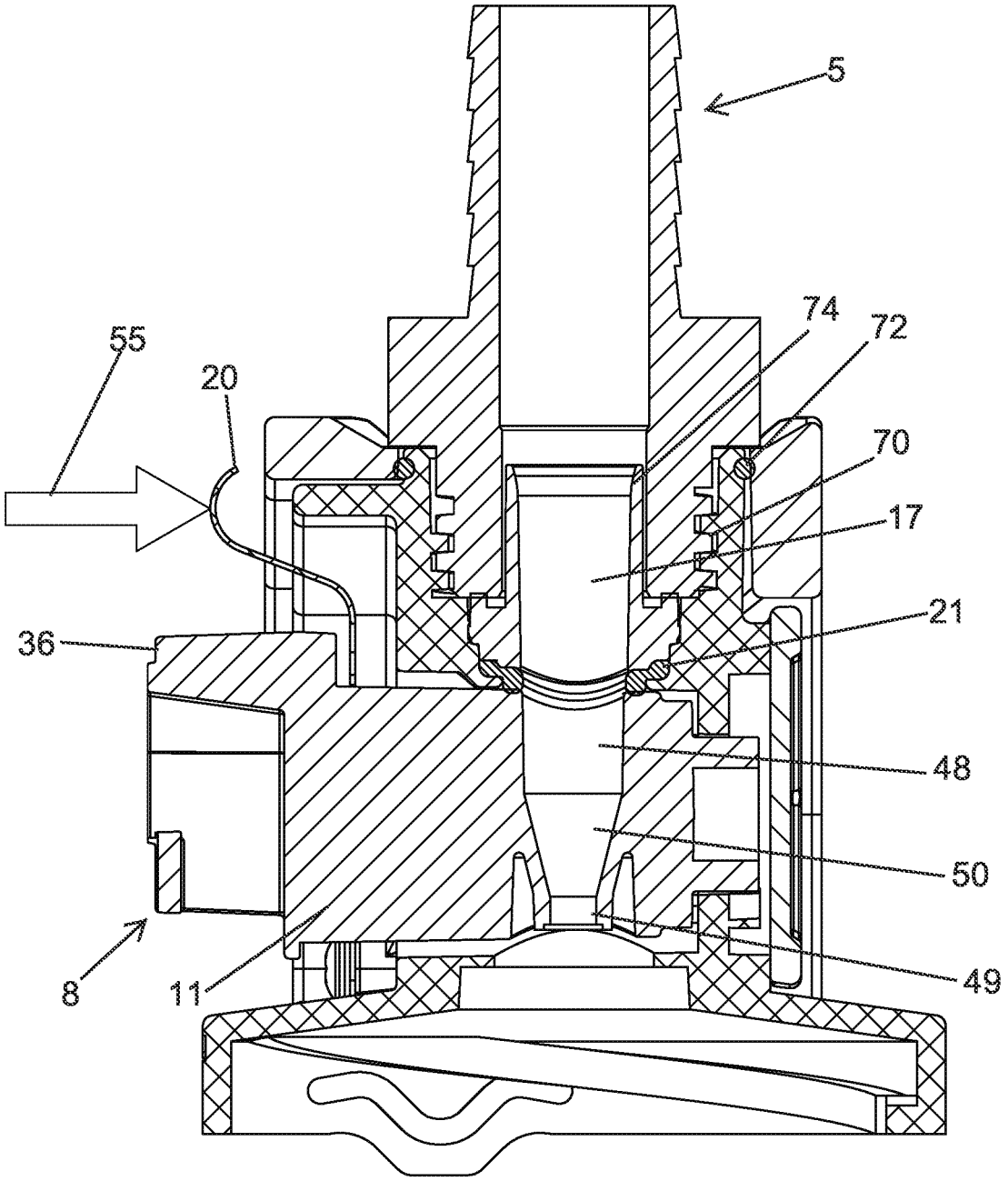
FIG. 14 illustrates a section view of a nozzle assembly with the nozzle insert in the RUN position and the push tab of the biasing plate depressed to release the detent of the rounded end of the turning knob of the nozzle insert in the RUN position.

FIG. 14 illustrates force 55 exerted upon the push tab 20 of the biasing plate. An operator depressing the biasing plate tab 20 moves biasing tab toward the front face of the nozzle body to relieve the detent around the round end 36 of the turning knob. Release of the detent allows the turning knob to be rotated in either a clockwise or counterclockwise direction to a different operating position.

Figure 15:
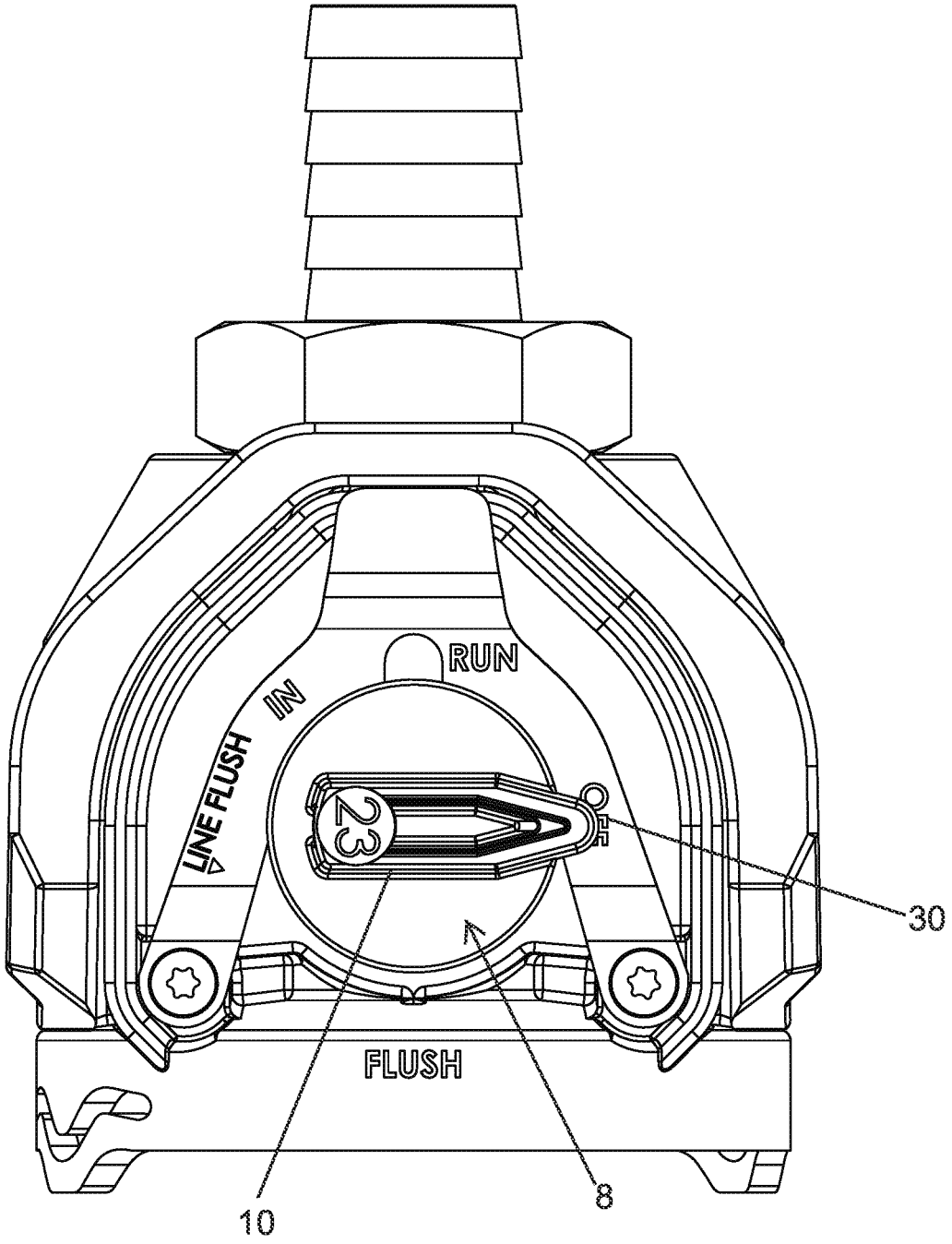
FIG. 15 illustrates a front view of a nozzle assembly with the nozzle insert in the OFF position.

FIG. 15 illustrates a front view of the nozzle assembly having the nozzle insert turning knob 10 rotated to be pointed at the OFF position.

Figure 16:
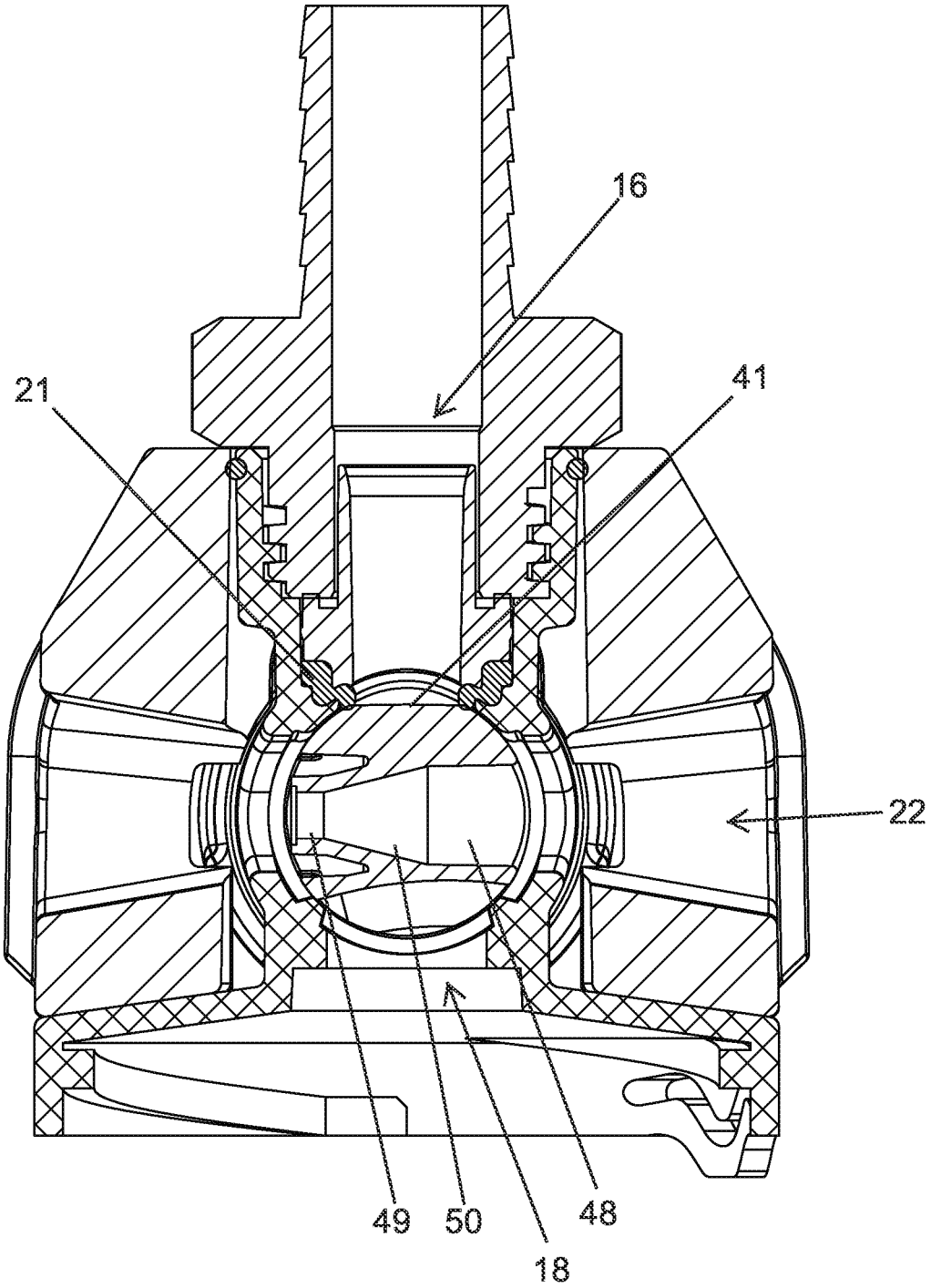
FIG. 16 illustrates a section view of a nozzle assembly with the nozzle insert in the OFF position.

FIG. 16 illustrates a section view of the nozzle assembly having the nozzle insert in the OFF position of FIG. 15. In the OFF position the nozzle insert is rotated such that the nozzle bore is generally perpendicular to the flow path through the nozzle body. The nozzle insert is oriented such that the stop depression 41 is facing the nozzle body inlet channel 16. The nozzle seal is positioned around the edges of the stop depression to prevent fluid from escaping from the inlet channel.

Figure 17:
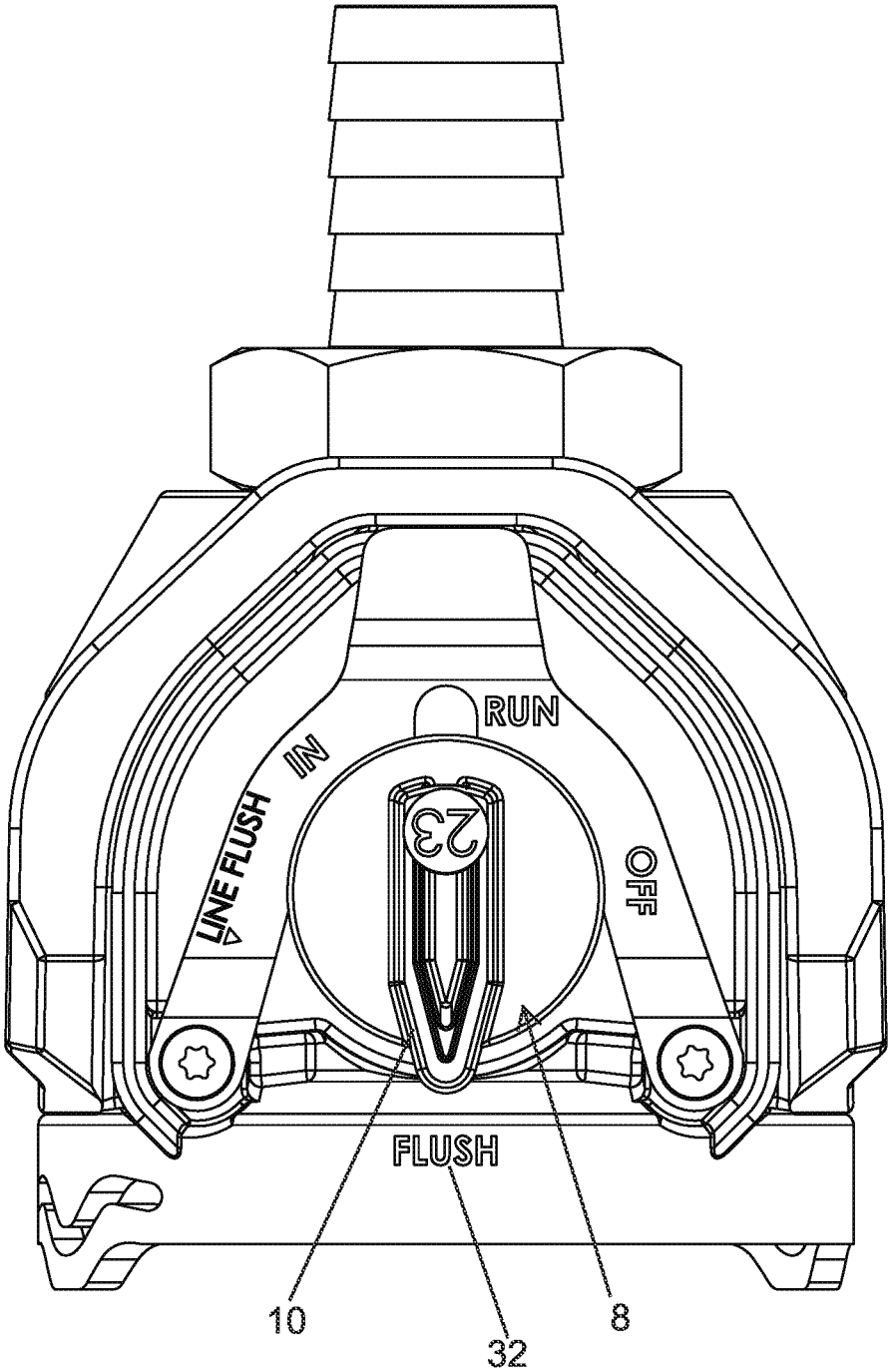
FIG. 17 illustrates a front view of a nozzle assembly with the nozzle insert in the FLUSH position.

FIG. 17 Illustrates the nozzle assembly and the nozzle insert rotated such that the turning knob is pointed toward the FLUSH position.

Figure 18:
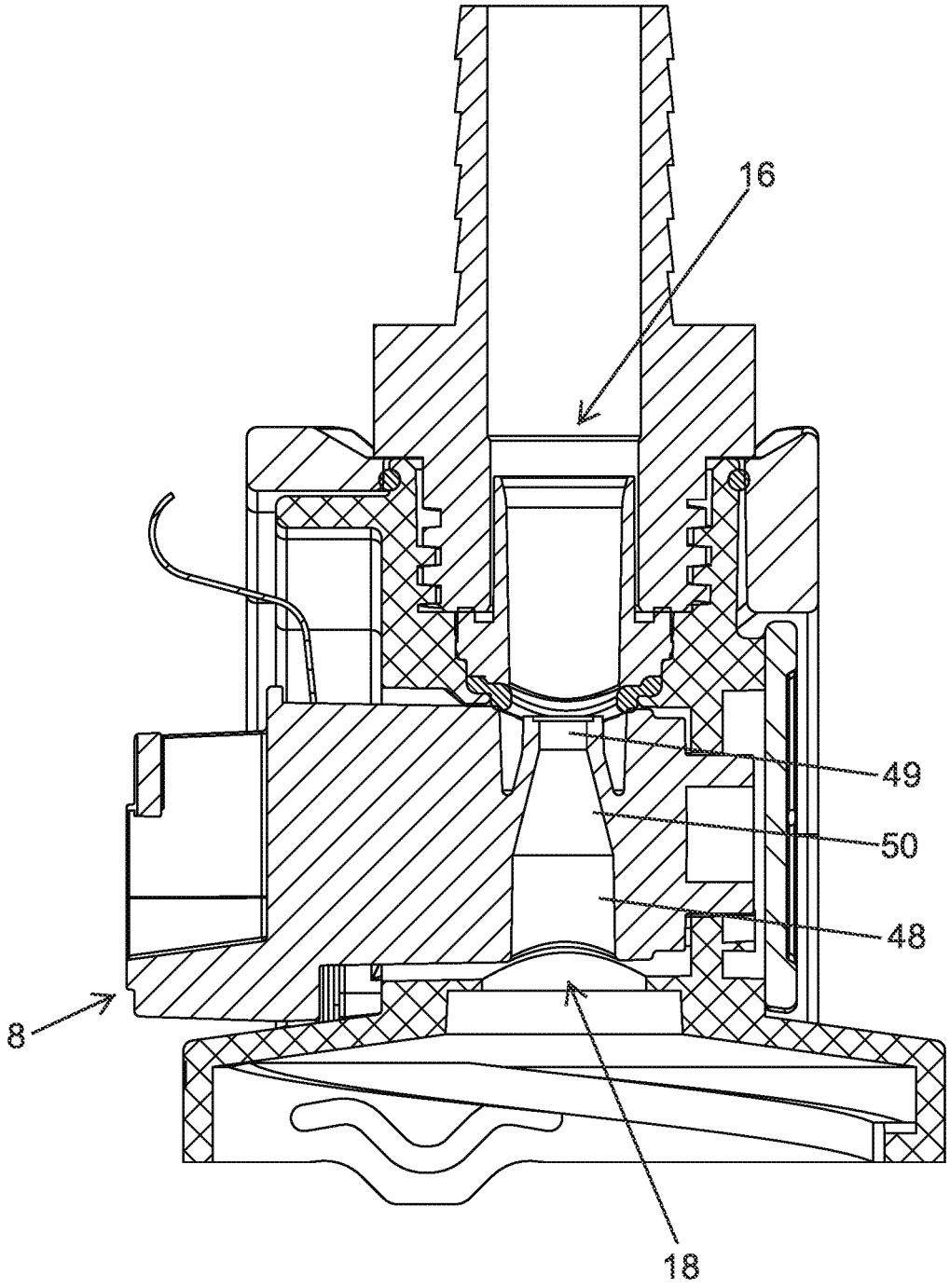
FIG. 18 illustrates a section view of a nozzle assembly with the nozzle insert in the FLUSH position.

FIG. 18 illustrates a section view showing the internal orientation of the nozzle insert relative to the nozzle body in the FLUSH position. In the FLUSH position the insert has been rotated 180 degrees from the RUN position such that the nozzle bore is in a reversed orientation from the RUN position. The nozzle outflow orifice 49 is now facing the nozzle body inlet channel 16. The constricting tube 50 of the nozzle bore has been reversed such that the narrow portion is upstream from the wider inflow orifice 48. In the FLUSH position fluid travels through the nozzle bore in an opposite direction as in the RUN position so as to flush any particulate matter or any other aggregated material from the nozzle bore.

Figure 19:
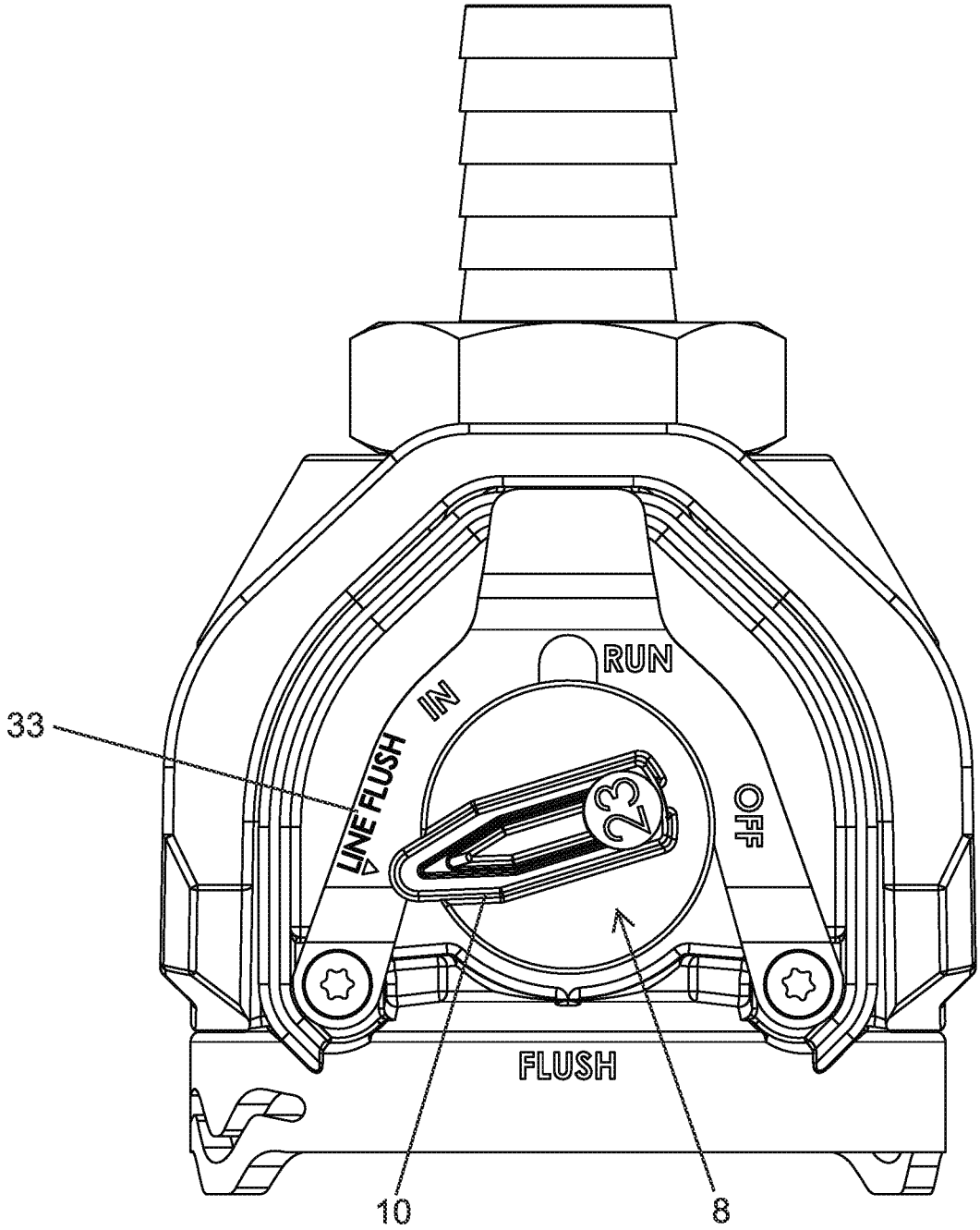
FIG. 19 illustrates a front view of a nozzle assembly with the nozzle insert in the LINE FLUSH position.

FIG. 19 illustrates the nozzle assembly having the nozzle insert in the LINE FLUSH position.

Figure 20:
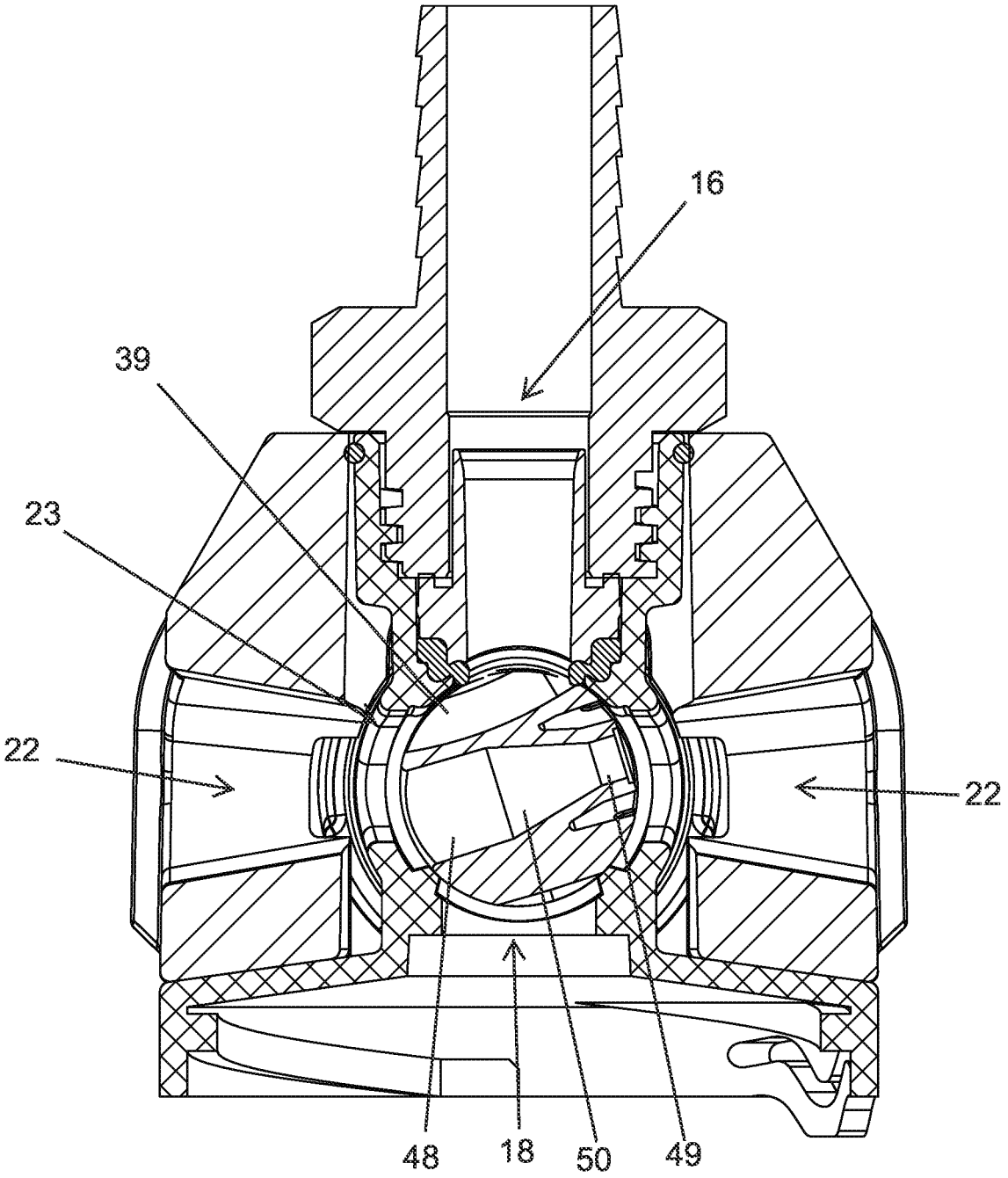
FIG. 20 illustrates a section view of a nozzle assembly with the nozzle insert in the LINE FLUSH position.

FIG. 20 illustrates a section view of the nozzle assembly of FIG. 19. In the LINE FLUSH position, the flush channel 39 in the nozzle insert is oriented relative to the inlet channel 16 of the nozzle body to direct fluid flow from the inlet channel out the flush opening 23 in the nozzle body and out the opening 22 in the weight. This function allows the operator to flush material from the irrigation line leading to the nozzle while bypassing the nozzle bore. This is beneficial if there is material larger than the nozzle bore in the irrigation line that needs to be flushed from the irrigation system.

FIGS. 21-36 present different embodiments of sprinkler bodies attached to various embodiments of the nozzle assembly. The attachment between the nozzle assembly and the sprinkler body can be in a variety of mechanisms, as shown in FIG. 21-36.

Figure 21:
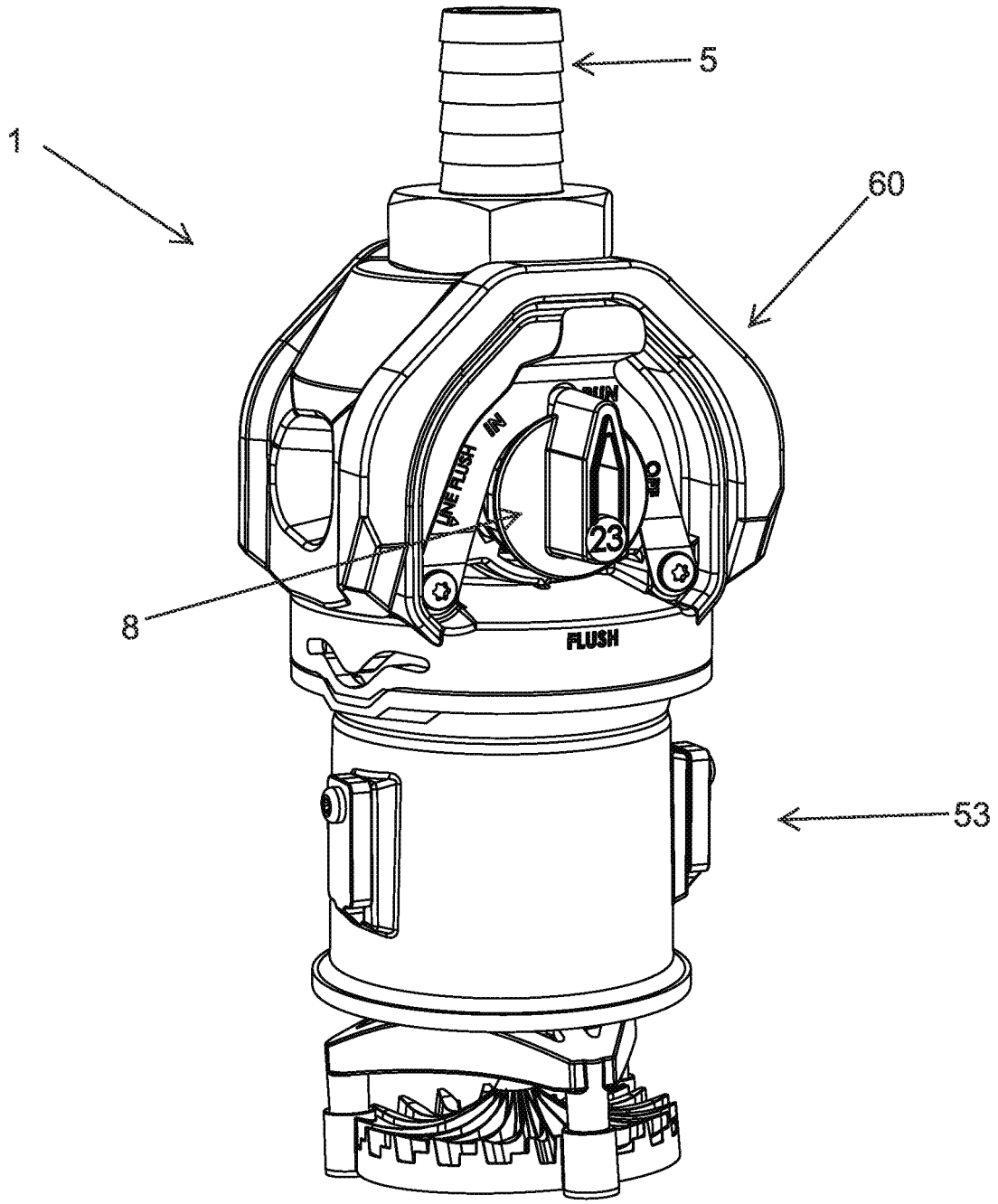
FIG. 21 illustrates a perspective view of a nozzle assembly attached to a sprinkler body.
Figure 22:
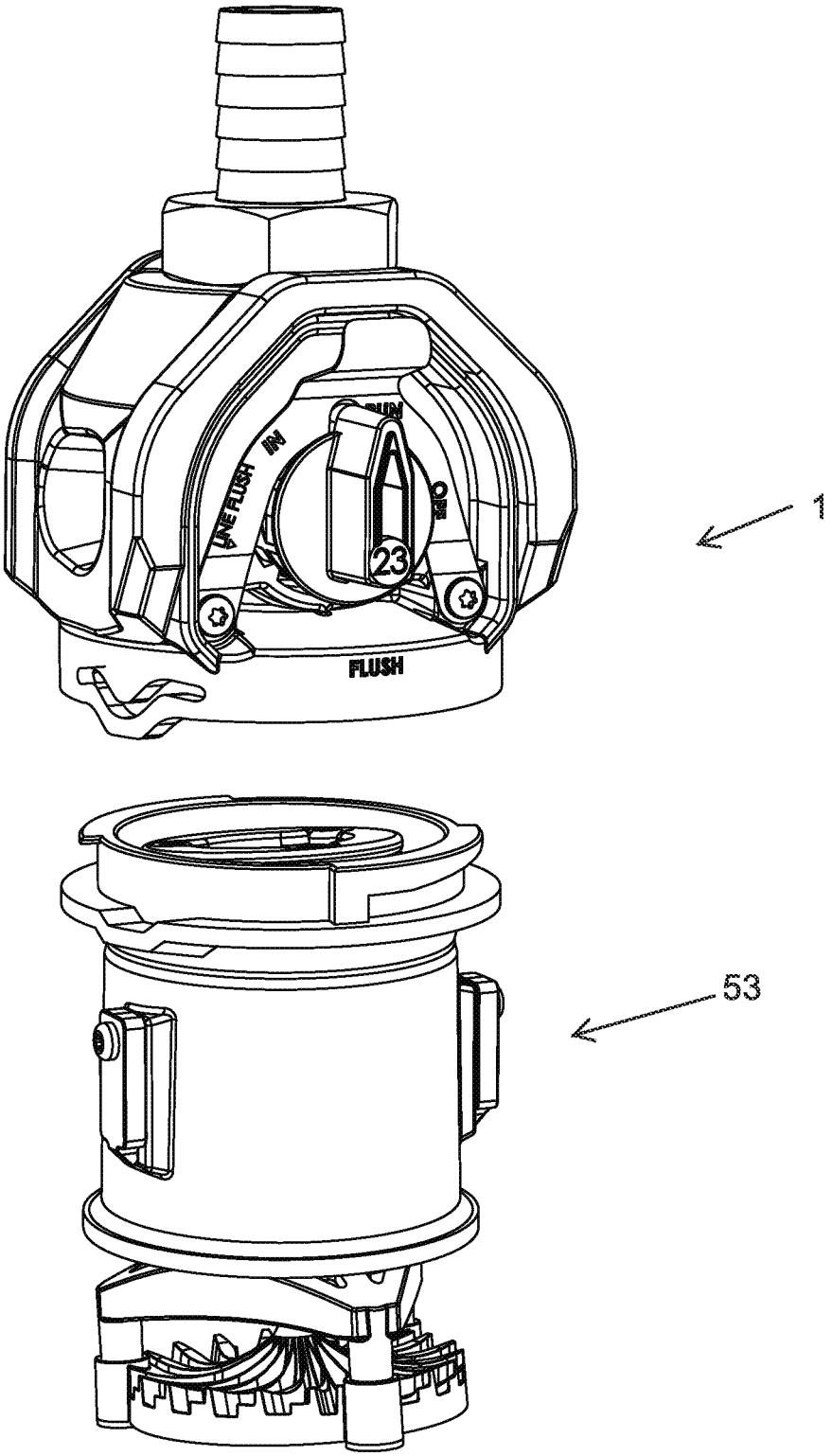
FIG. 22 illustrates an exploded view of the nozzle assembly and sprinkler body of FIG. 21.

FIG. 21-26 illustrates a helical quick connect connecting the nozzle assembly to the sprinkler body. FIG. 21 is a perspective view of a nozzle assembly 1 attached to a sprinkler body 53. FIG. 22 is a perspective partially exploded view of the nozzle assembly detached from the sprinkler body 53 illustrating the threaded quick connect components of the sprinkler body and the nozzle assembly. The connection mechanism allows for nozzle assembly and sprinkler body to be detached for maintenance and/or for replacement of one or the other.

Figure 23:
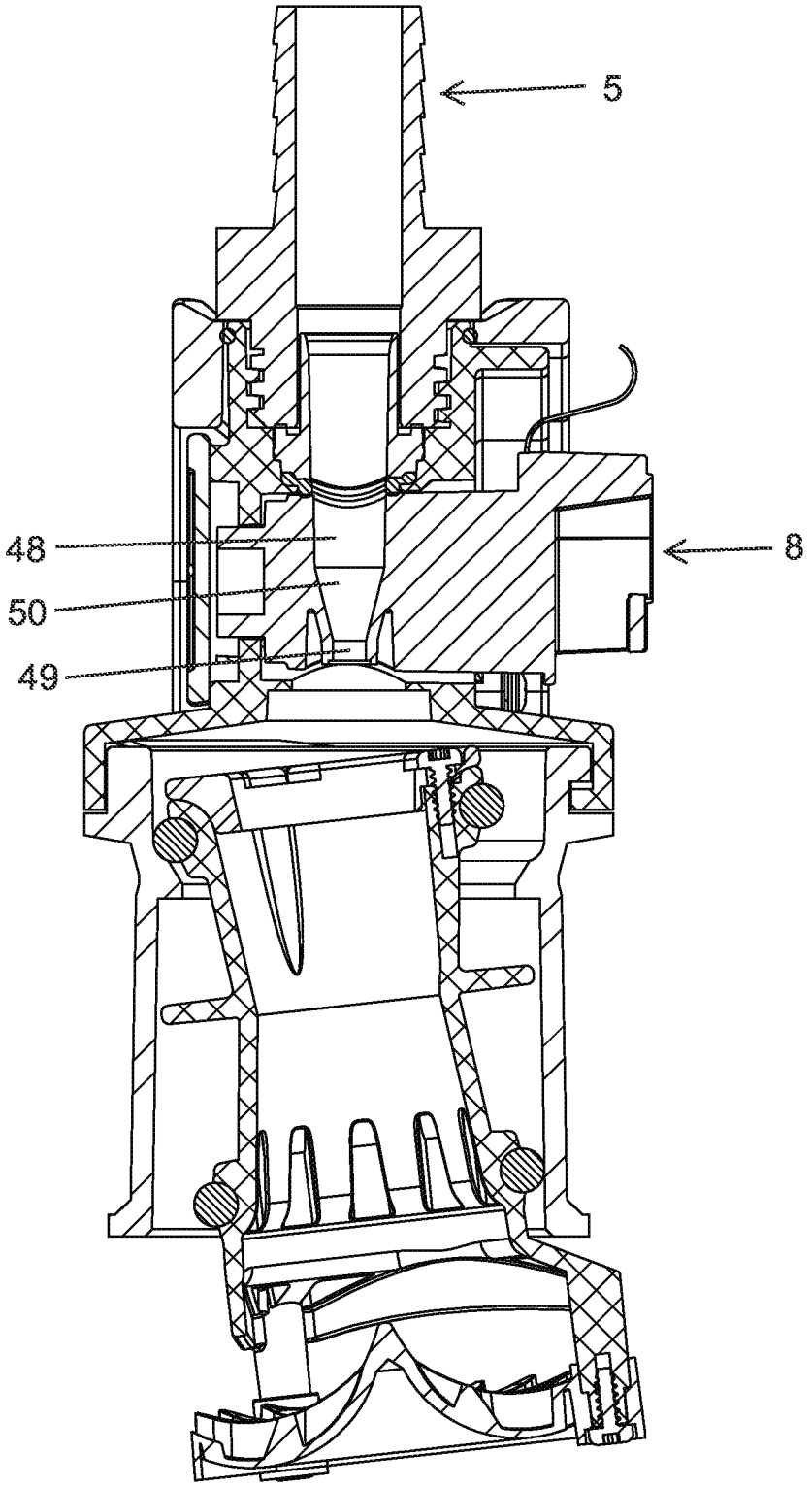
FIG. 23 illustrates a section view of the nozzle assembly and sprinkler body of FIG. 21.

FIG. 23 illustrates a section view of the nozzle assembly and sprinkler body of FIG. 21. The sprinkler body provides an example of a fluid distribution mechanism housed within the sprinkler body. The example given is described in further detail, for example, in U.S. patent application Ser. No. 16/813,598.

Figure 24:
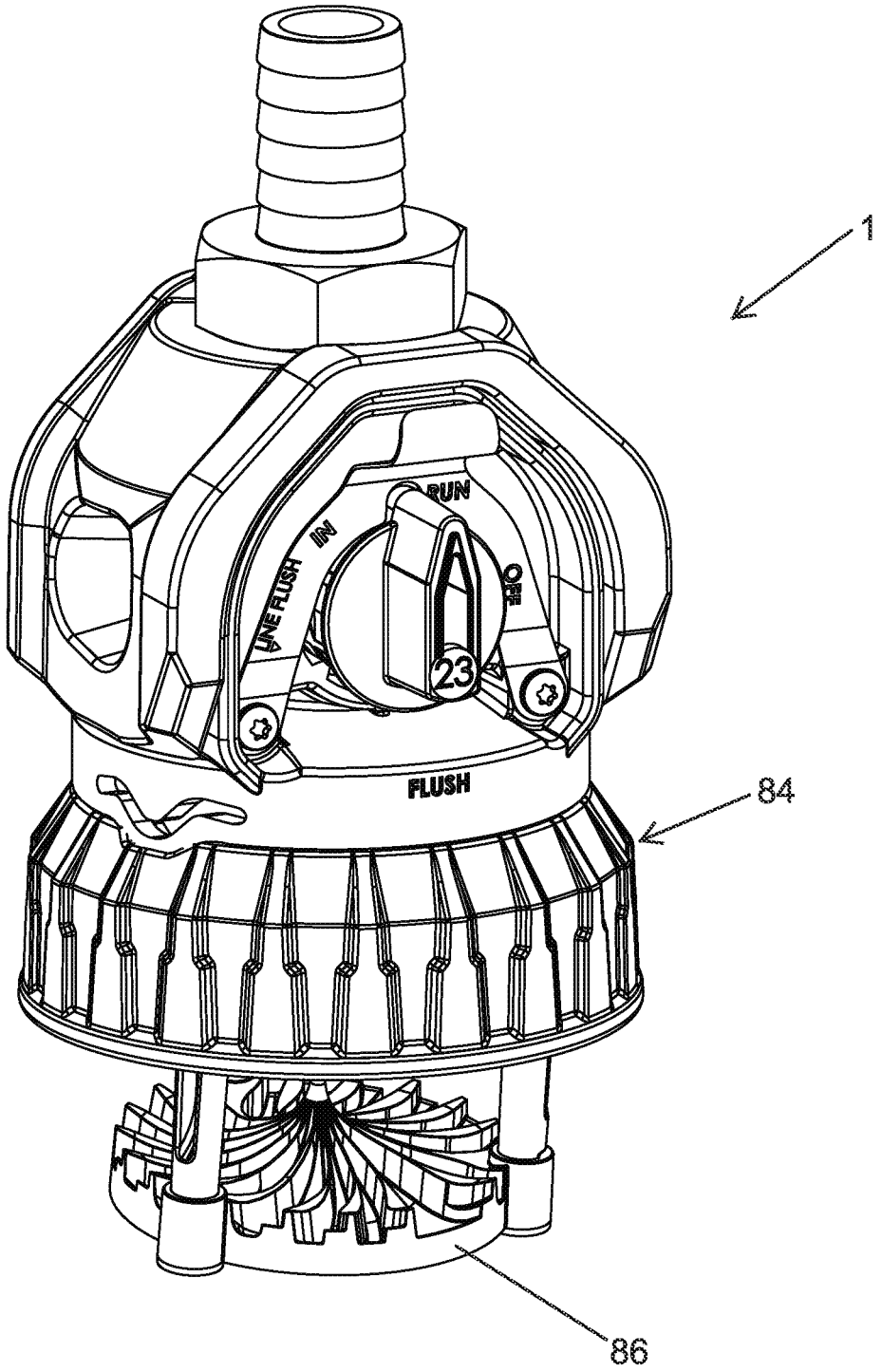
FIG. 24 illustrates a perspective view of a nozzle assembly attached to a sprinkler body.

FIG. 24 illustrates a perspective view of a FIG. 21 is a perspective view of a nozzle assembly attached to a sprinkler body 84.

Figure 25:
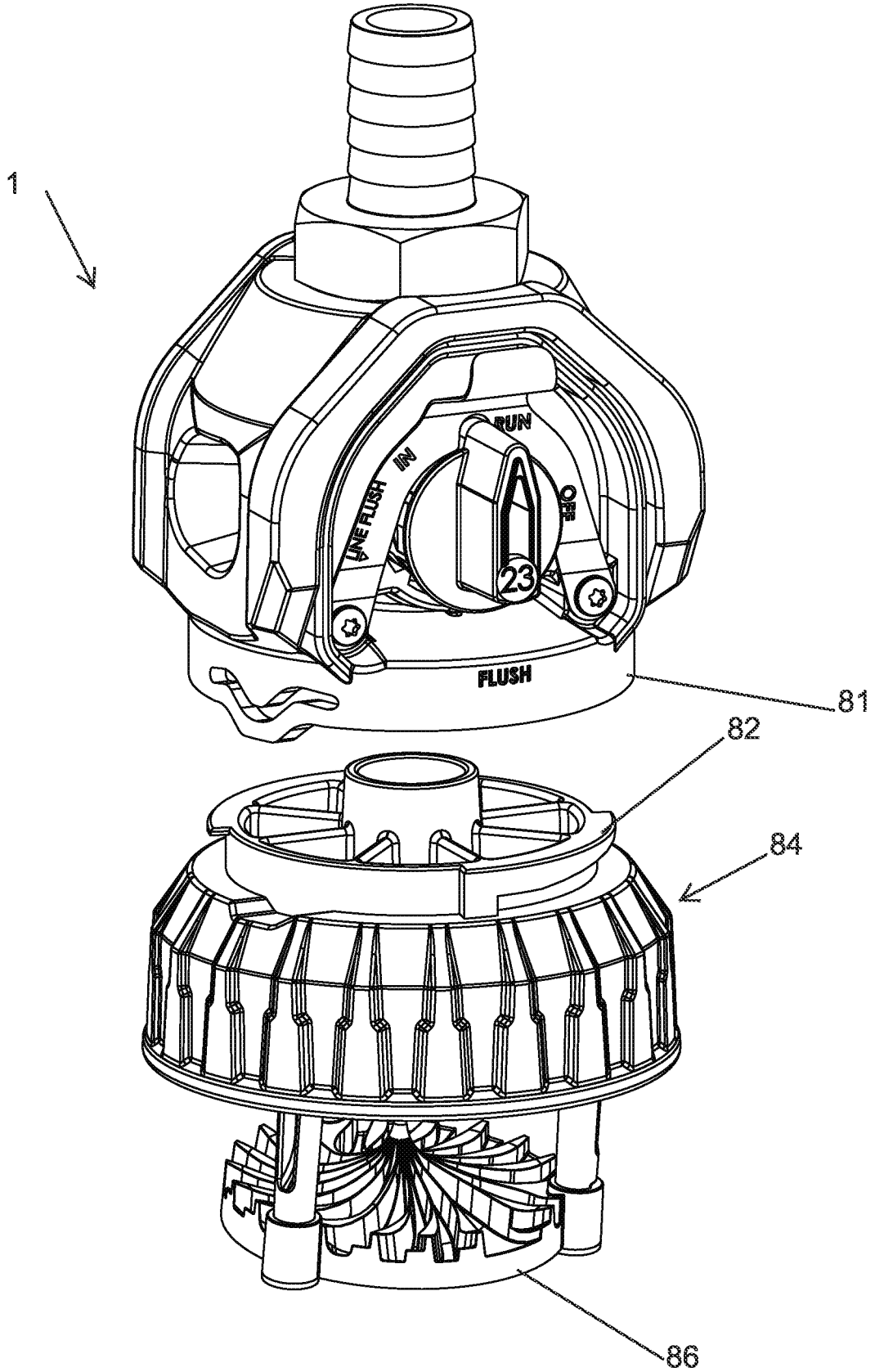
FIG. 25 illustrates a partially exploded view of the nozzle assembly and sprinkler body of FIG. 24.

FIG. 25 is a perspective partially exploded view of the nozzle assembly and sprinkler body of FIG. 24. The nozzle body is detached from the sprinkler body 84 illustrating the threaded quick connect components 82 of the sprinkler body and the threaded quick connect components 81 of the nozzle assembly.

Figure 26:
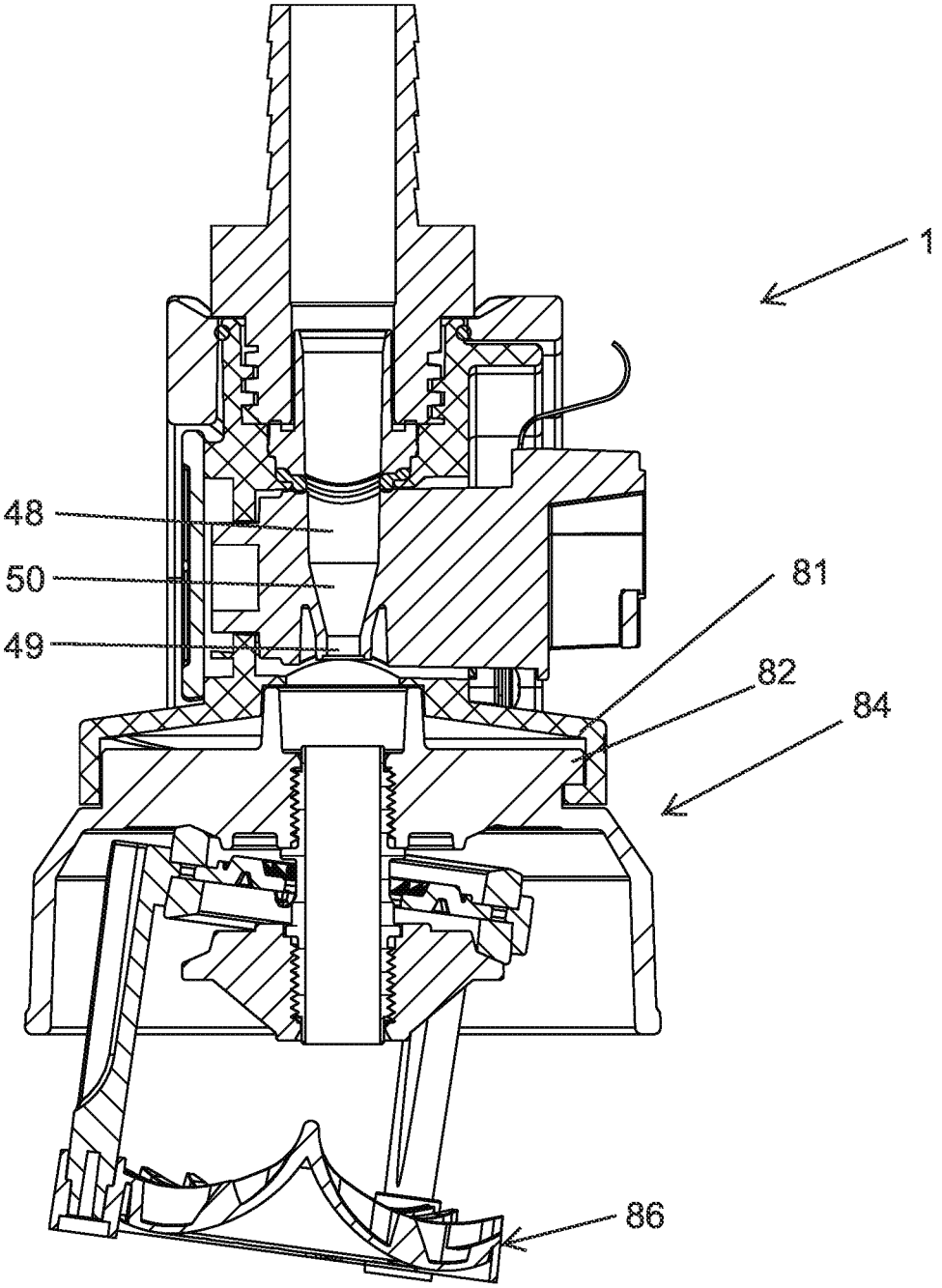
FIG. 26 illustrates a section view of the nozzle assembly and sprinkler body of FIG. 24.

FIG. 26 illustrates a section view of the nozzle assembly and sprinkler body of FIG. 24. The example fluid distribution mechanism of the sprinkler body of FIG. 24 utilizes a cage having an upper cage plate positioned between two sprinkler body plates. Fluid sprayed through the nozzle bore impinges on the distribution plate 86 of the cage, causing nutation of the upper cage plate between the two sprinkler plates.

Figure 27:
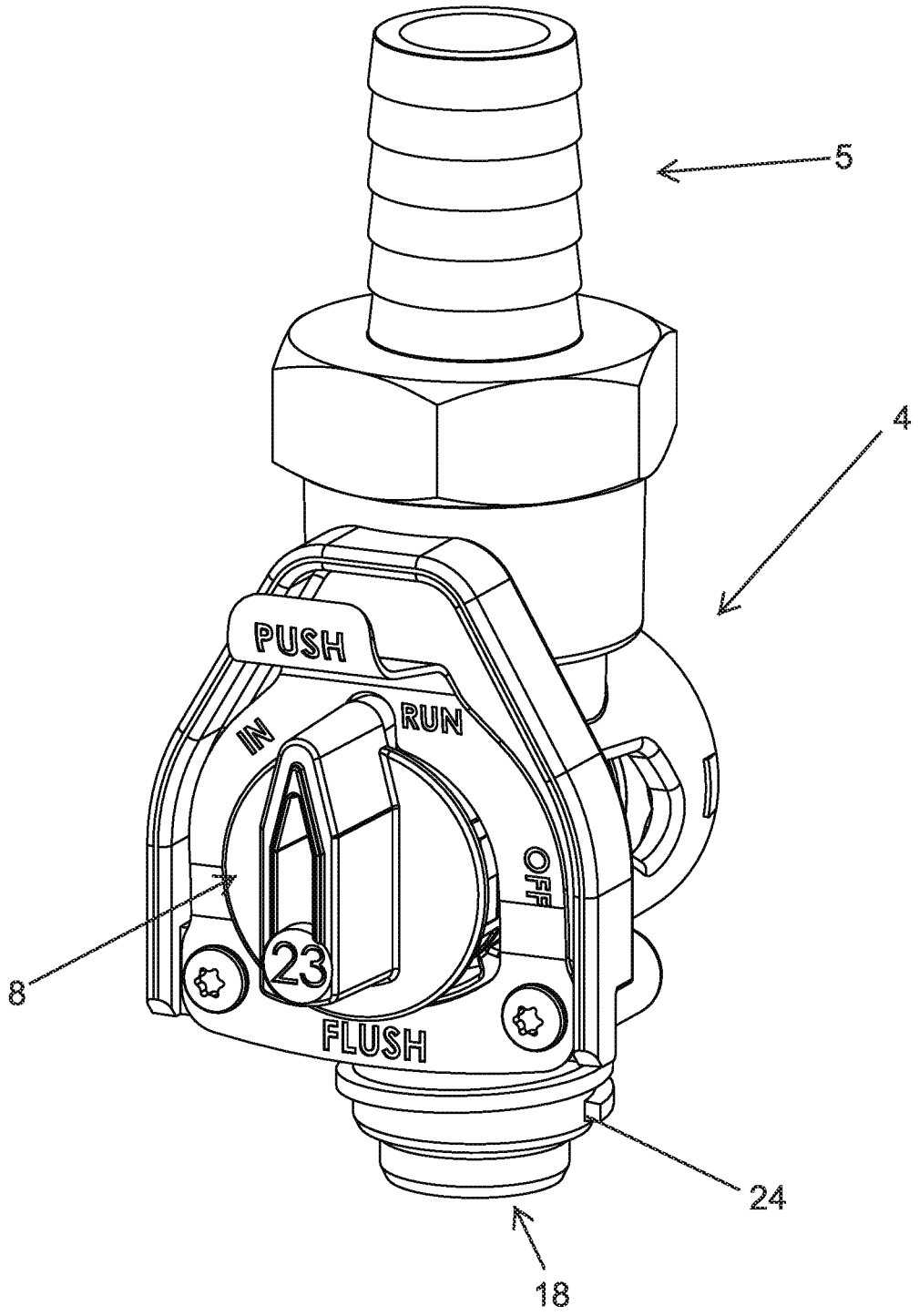
FIG. 27 illustrates a perspective view of a nozzle assembly including a nozzle body, a nozzle insert positioned in the nozzle body, and an adapter.
Figure 28:
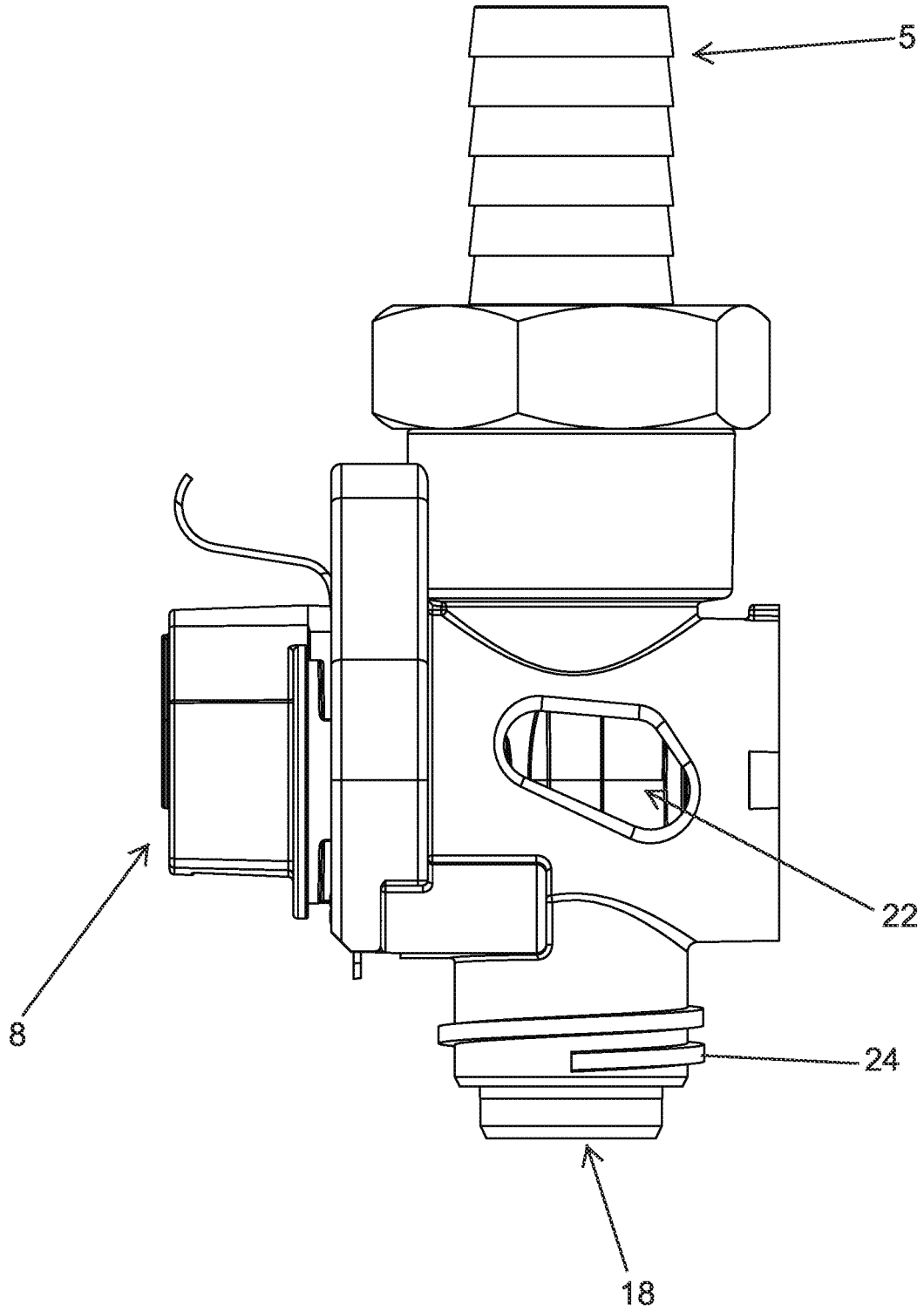
FIG. 28 illustrates a side view of the nozzle assembly of FIG. 27.

FIG. 27 illustrates an embodiment of the nozzle assembly having an adapter 5, a nozzle body 4, and a nozzle insert 8. The nozzle body is configured to attach to a sprinkler body via a threaded connection 24. This embodiment is shown connected to a sprinkler body in FIG. 29.

Figure 29:
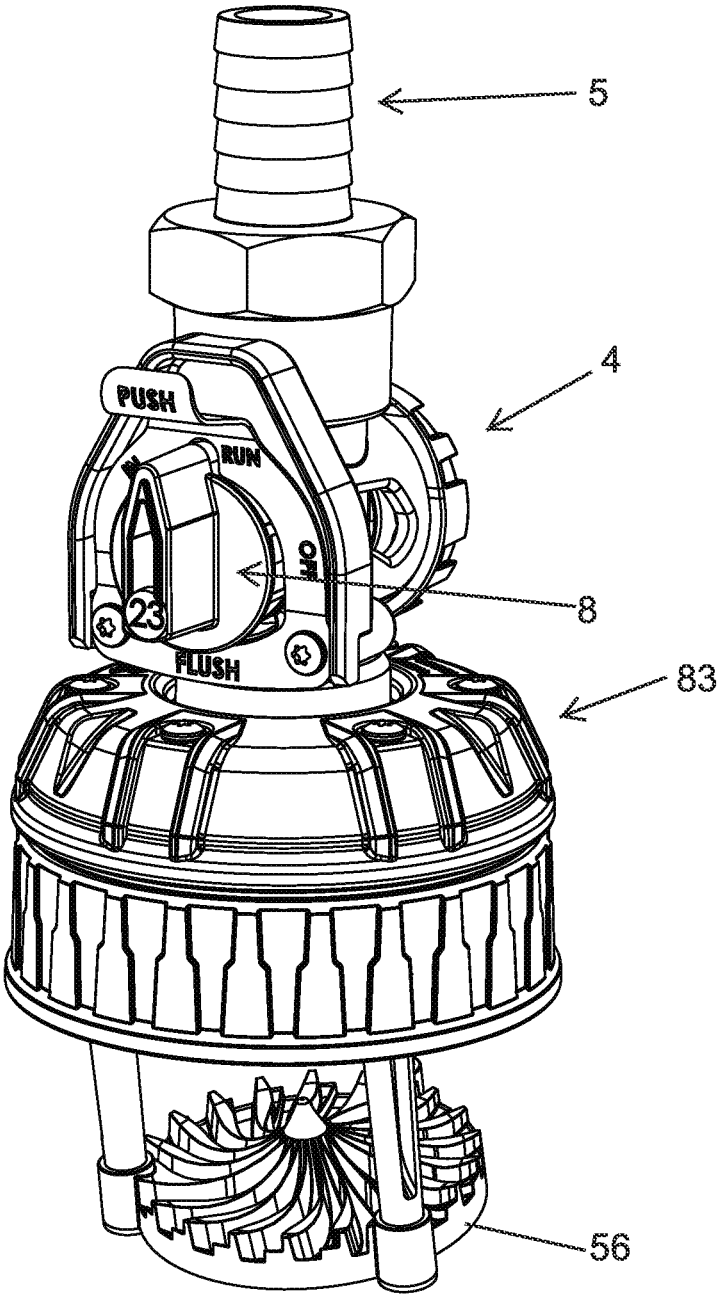
FIG. 29 illustrates a perspective view of a nozzle assembly attached to a sprinkler body.

FIG. 29 illustrates sprinkler body 83 connected to the nozzle assembly of FIG. 21. The sprinkler body houses a nutating mechanism utilizing a distribution disc 56 to distribute fluid sprayed from the nozzle or a nozzle bore onto the distribution disc.

Figure 30:
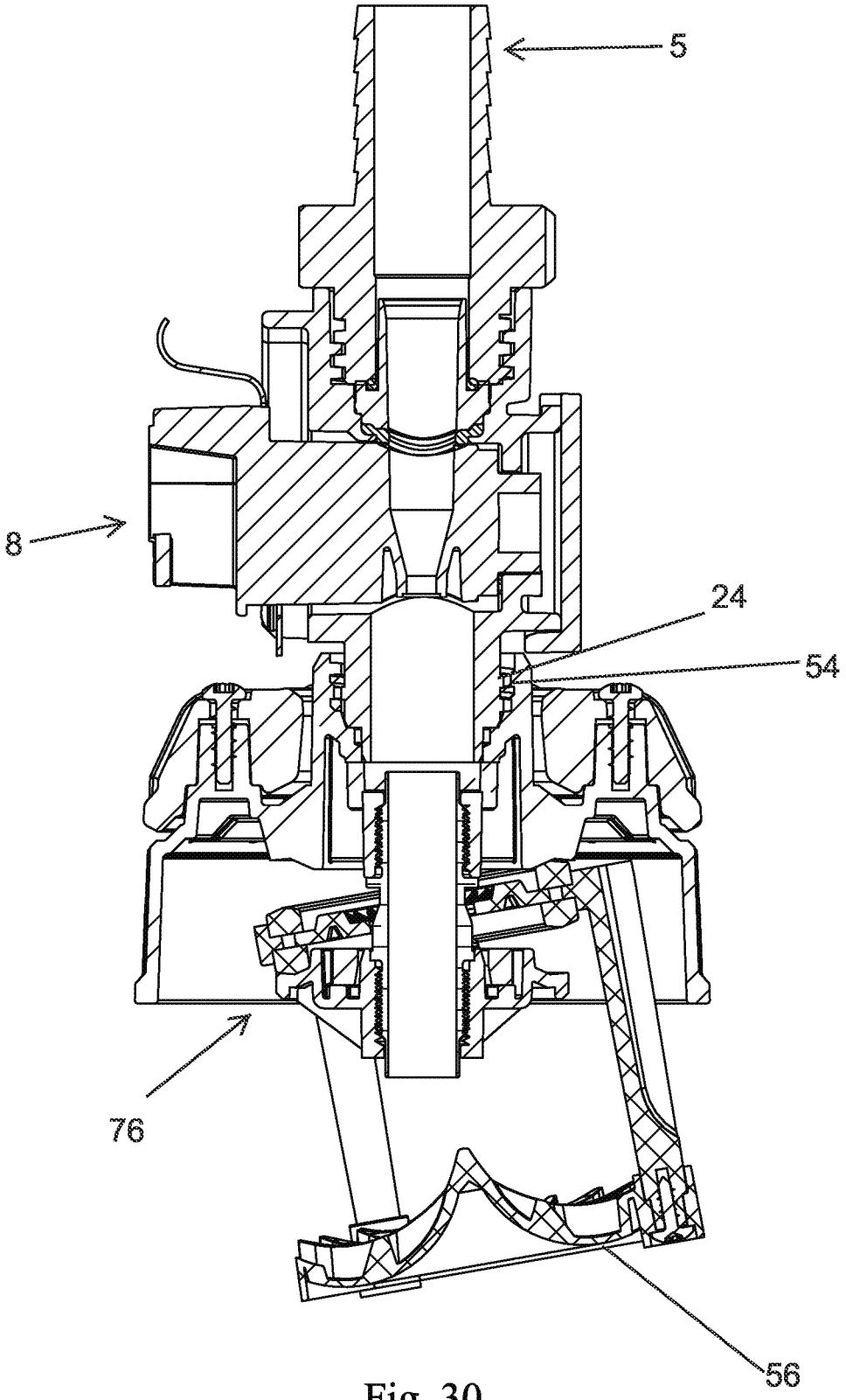
FIG. 30 illustrates a section view of the nozzle assembly and sprinkler body of FIG. 29.

FIG. 30 illustrates a section view of the embodiment shown in FIG. 29 attached to a sprinkler body. The internal nutating assembly 76 is shown.

Figure 31:
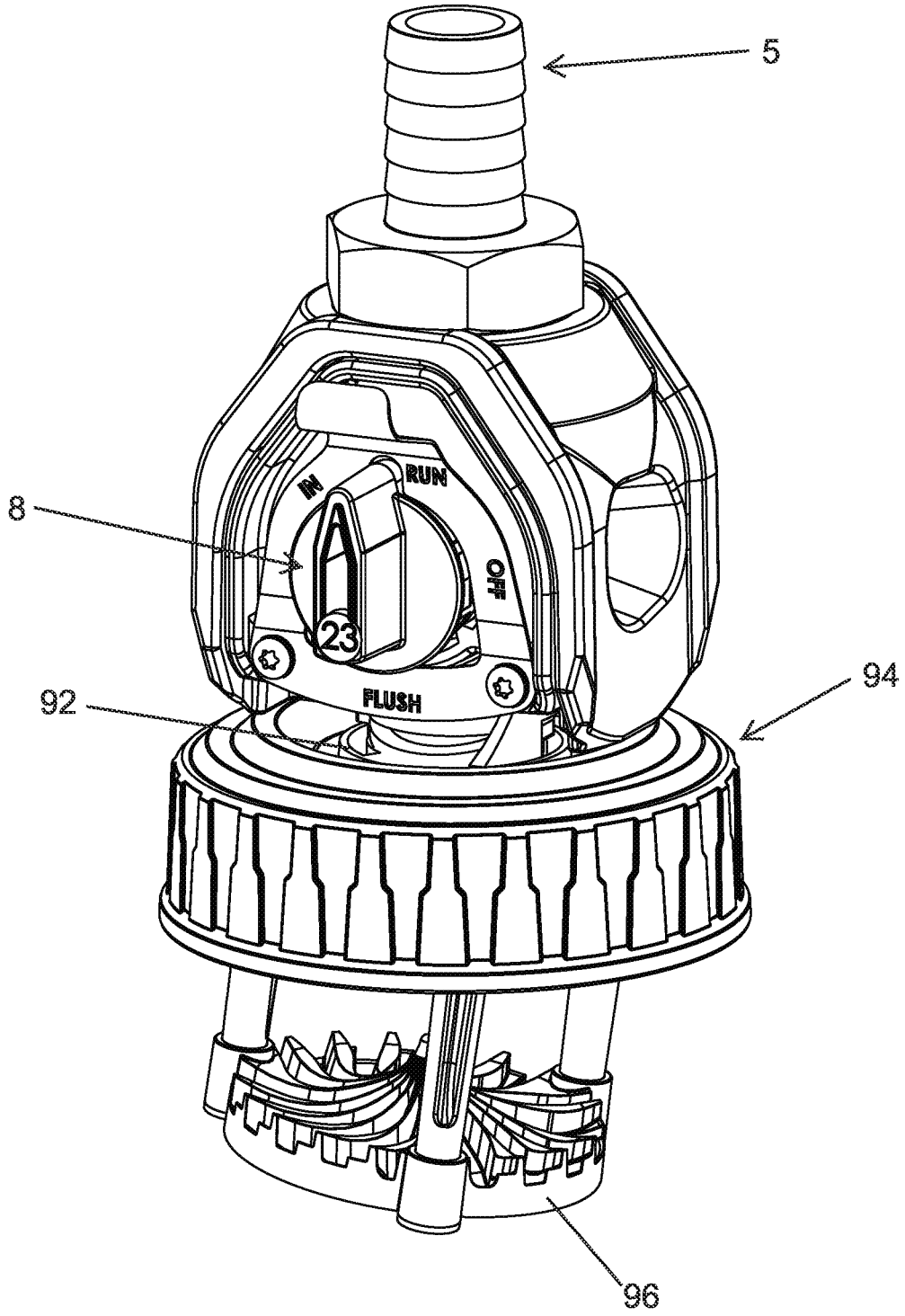
FIG. 31 illustrates a perspective view of a nozzle assembly attached to a sprinkler body.

FIG. 31 illustrates a nozzle assembly 1 attached to a sprinkler body via a bayonet fitting or bayonet connection. The bayonet connection uses a male component 90 and a female component 92, although these components can be reversed between the sprinkler body 94 and the nozzle assembly 1.

Figure 32:
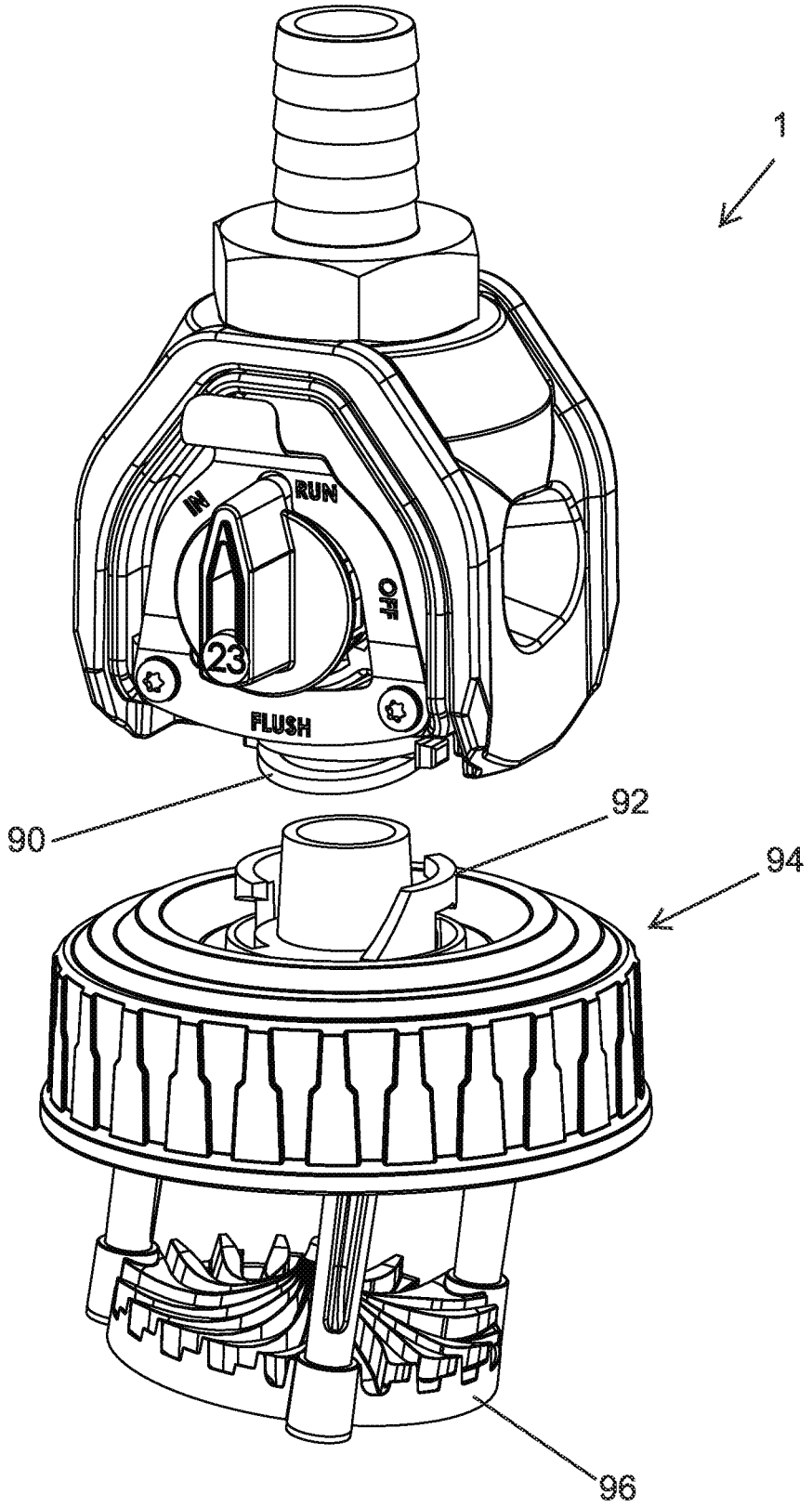
FIG. 32 illustrates a partially exploded view of the nozzle assembly and sprinkler body of FIG. 31.

FIG. 32 a perspective partially exploded view of the nozzle assembly and sprinkler body of FIG. 31. The nozzle assembly is detached from the sprinkler body 53 illustrating the bayonet fitting components of the sprinkler body and the nozzle assembly.

Figure 33:
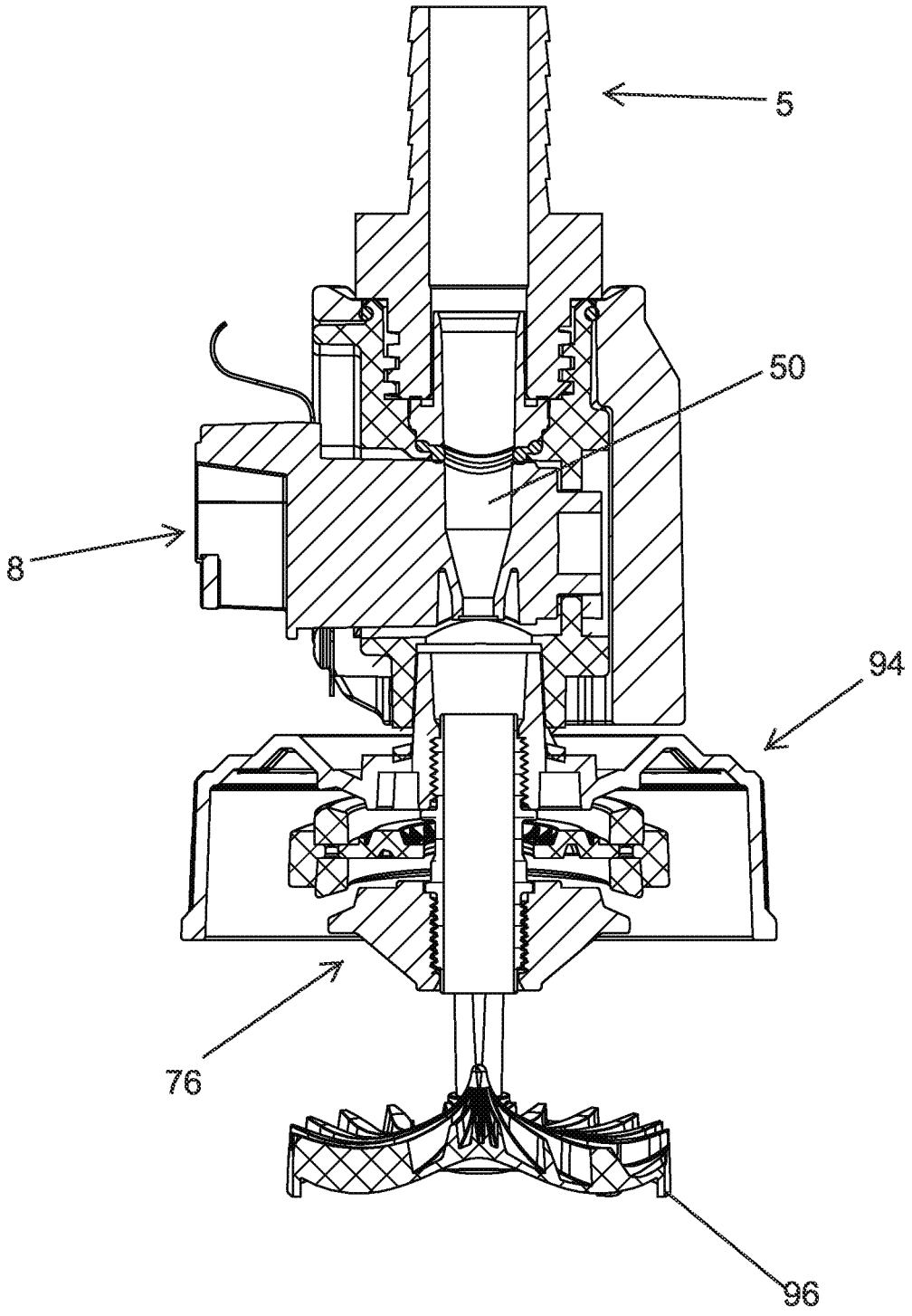
FIG. 33 illustrates a section view of the nozzle assembly and sprinkler body of FIG. 31.

FIG. 33 illustrates a section view of the embodiment shown in FIG. 32. The sprinkler body is housing an internal nutating component 76 to provide for the nutating motion of the distribution disc when fluid is sprayed onto the distribution disc from the nozzle bore 50.

Figure 34:
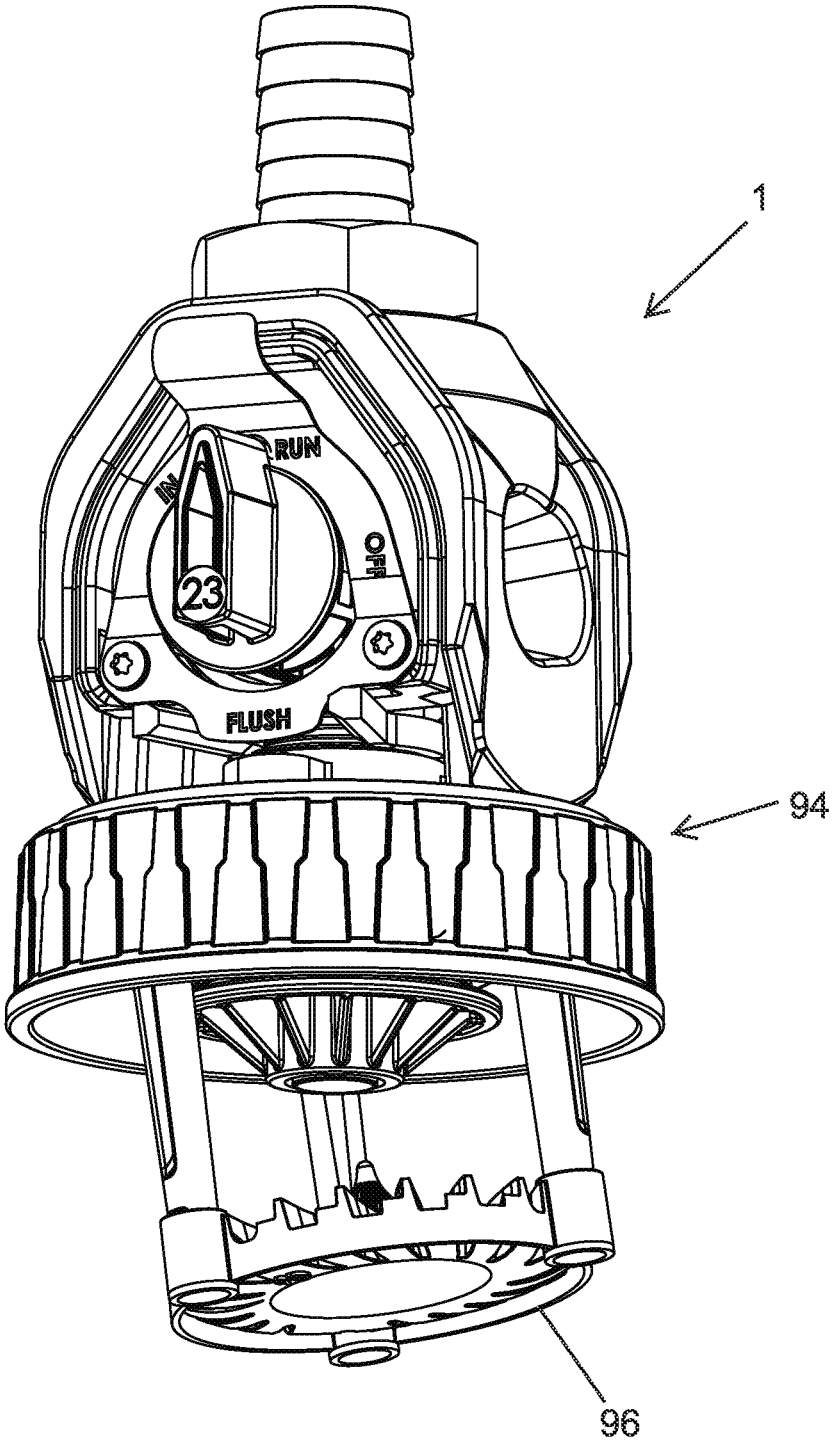
FIG. 34 illustrates a perspective view of a nozzle assembly attached to a sprinkler body.
Figure 35:
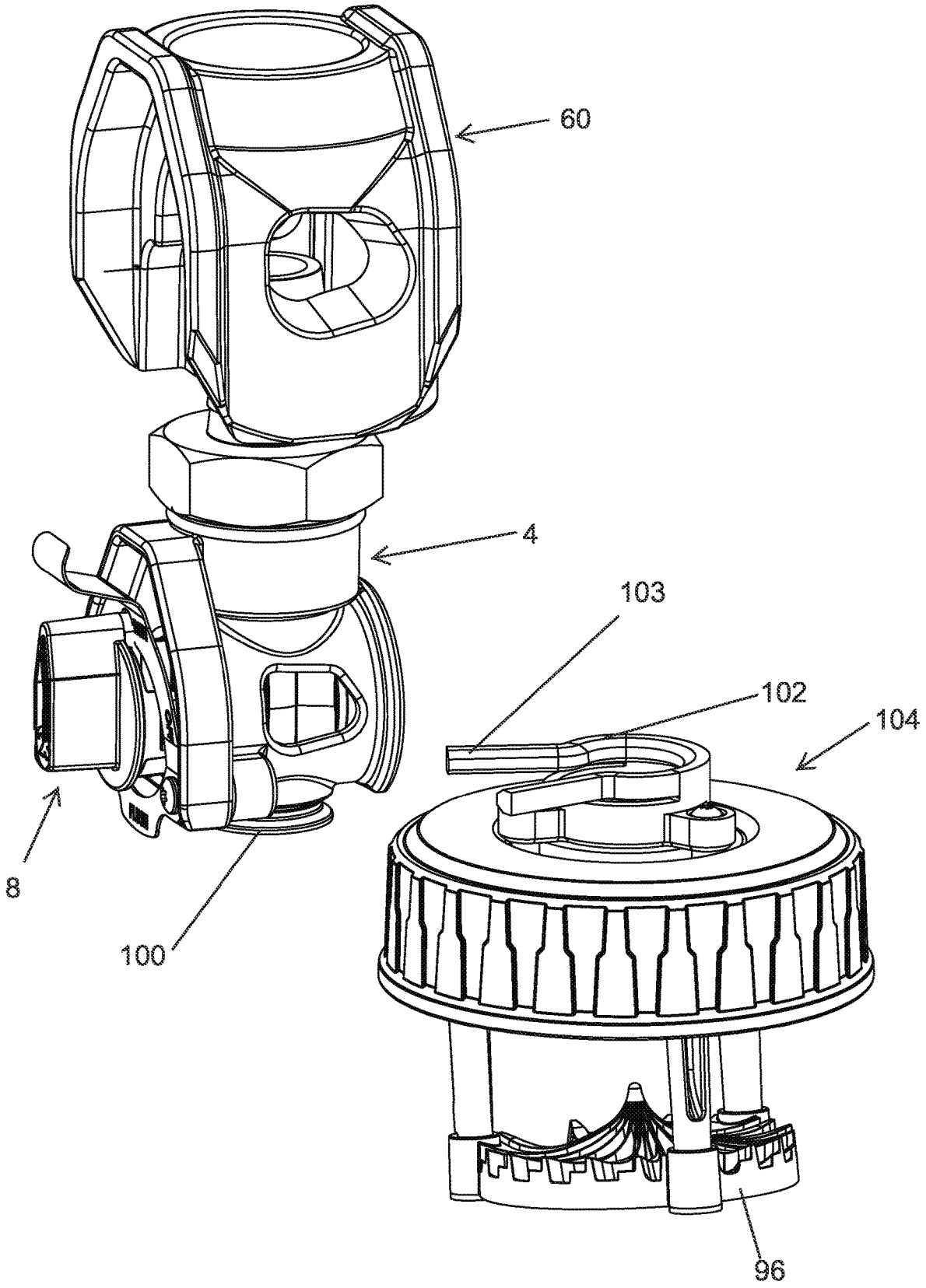
FIG. 35 illustrates a partially exploded view of the nozzle assembly and sprinkler body of FIG. 34.
Figure 36:
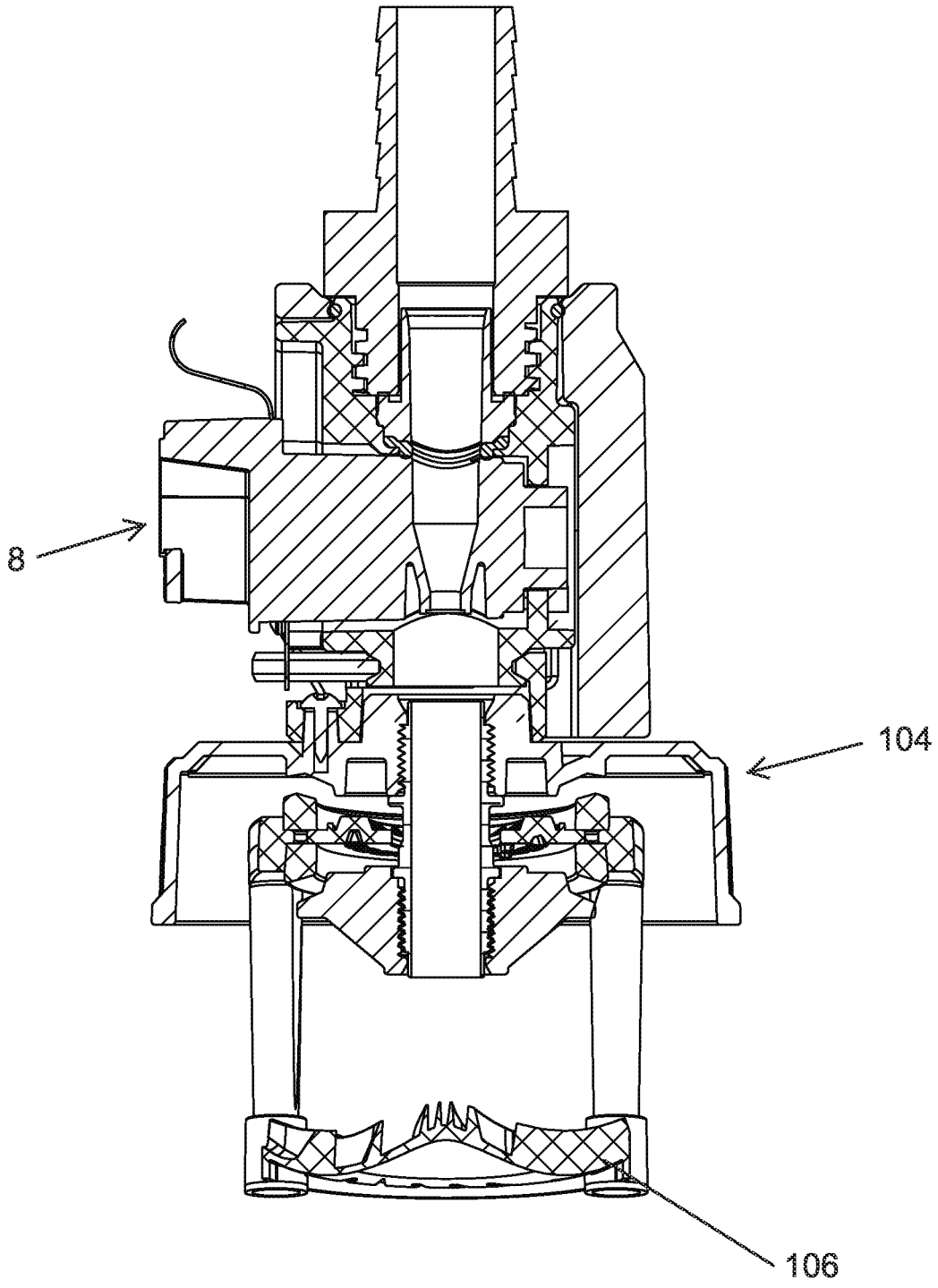
FIG. 36 illustrates a section view of the nozzle assembly and sprinkler body of FIG. 34.

FIG. 34 illustrates a further embodiment of a nozzle assembly 1 connected to a sprinkler body 94. A distribution disc 96 is illustrated for distributing fluid that has been sprayed through the nozzle insert. The connection between the nozzle assembly 1 and the sprinkler body 94 in FIGS. 34-36 is a side load clip. As shown in FIG. 35 the side load clip includes a clip 102 at the top of the sprinkler body 104. The clip is configured to attach at a groove 100 of the nozzle assembly. The sprinkler body is removed from the nozzle assembly by exerting outward pressure on one or both of nozzle clip arms 103 and the nozzle clip is laterally slid off the nozzle assembly.

Figure 37A:
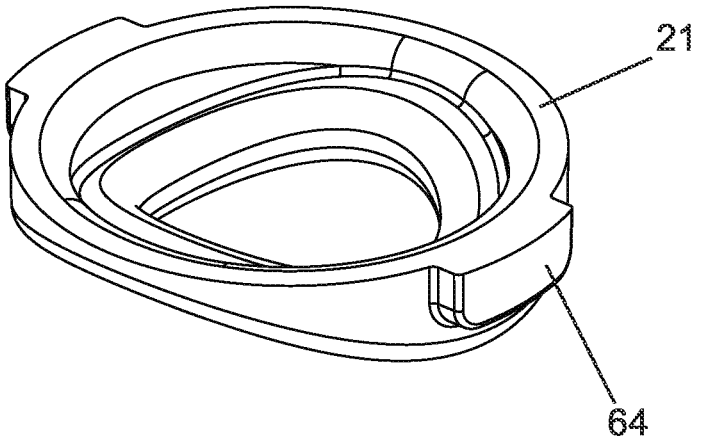
FIG. 37*a* illustrates a top perspective view of a preferred embodiment of a seal for positioning between the nozzle body and nozzle insert.
Figure 37B:
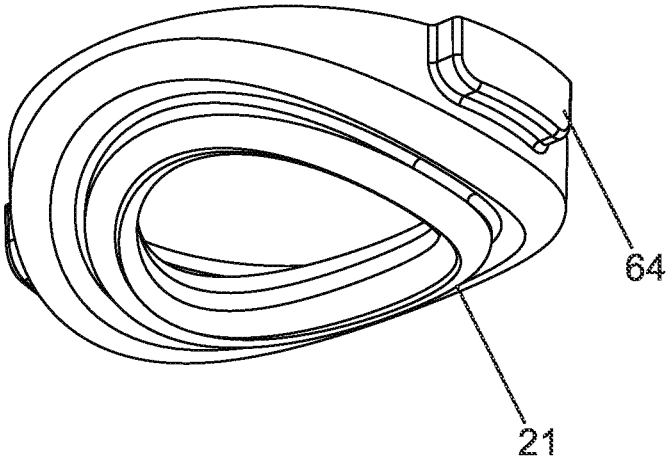
FIG. 37*b* illustrates a bottom perspective view of the seal of FIG. 37*a*.

FIGS. 37*a* and 37*b* illustrate perspective views of the preferred embodiment of the nozzle seal 21. The nozzle seal has locating tabs positioned on either side of the nozzle seal. The nozzle seal is formed in a concave shape. The concave shape facilitates the nozzle seal against the nozzle insert in the nozzle body. The locating tabs are configured to seat in locating notches within the nozzle body.

Figure 38:
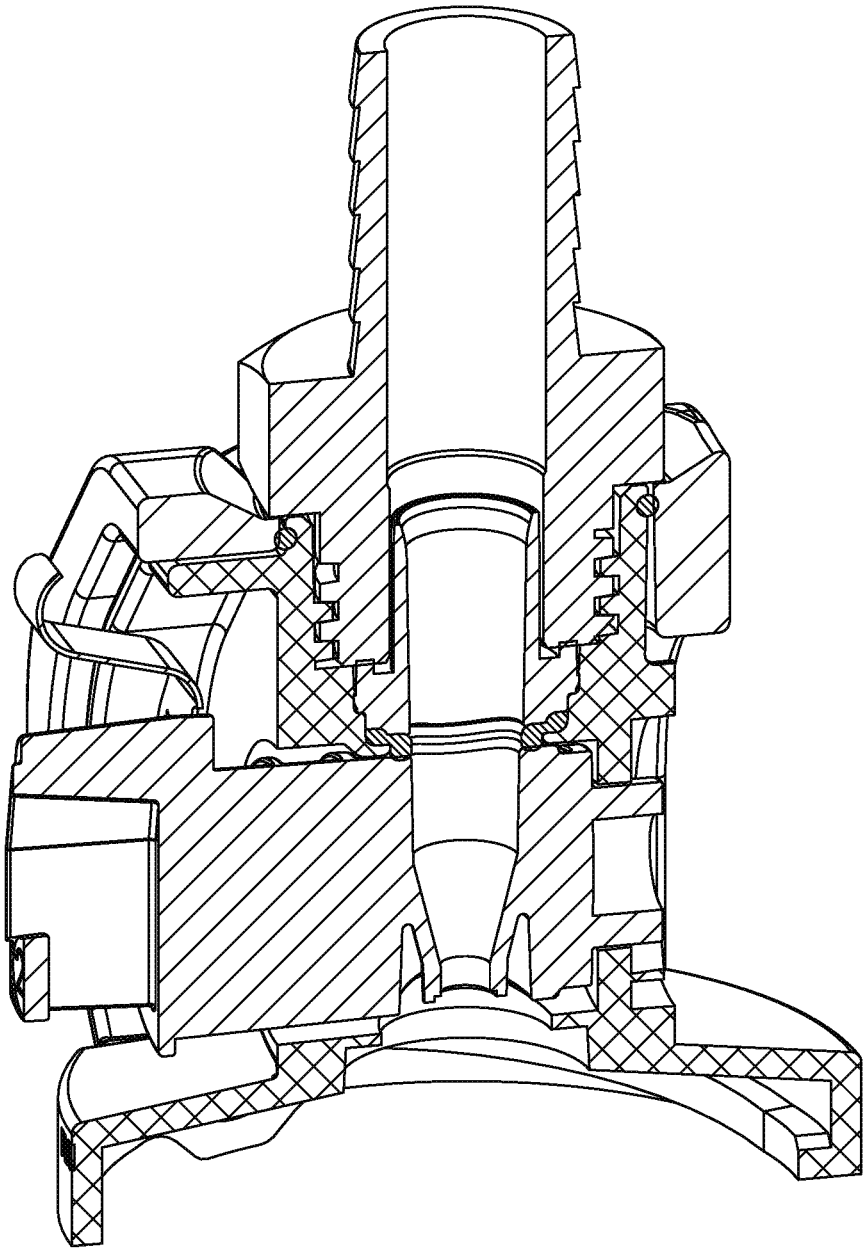
FIG. 38 is an isometric section view of a nozzle assembly.
Figure 39:
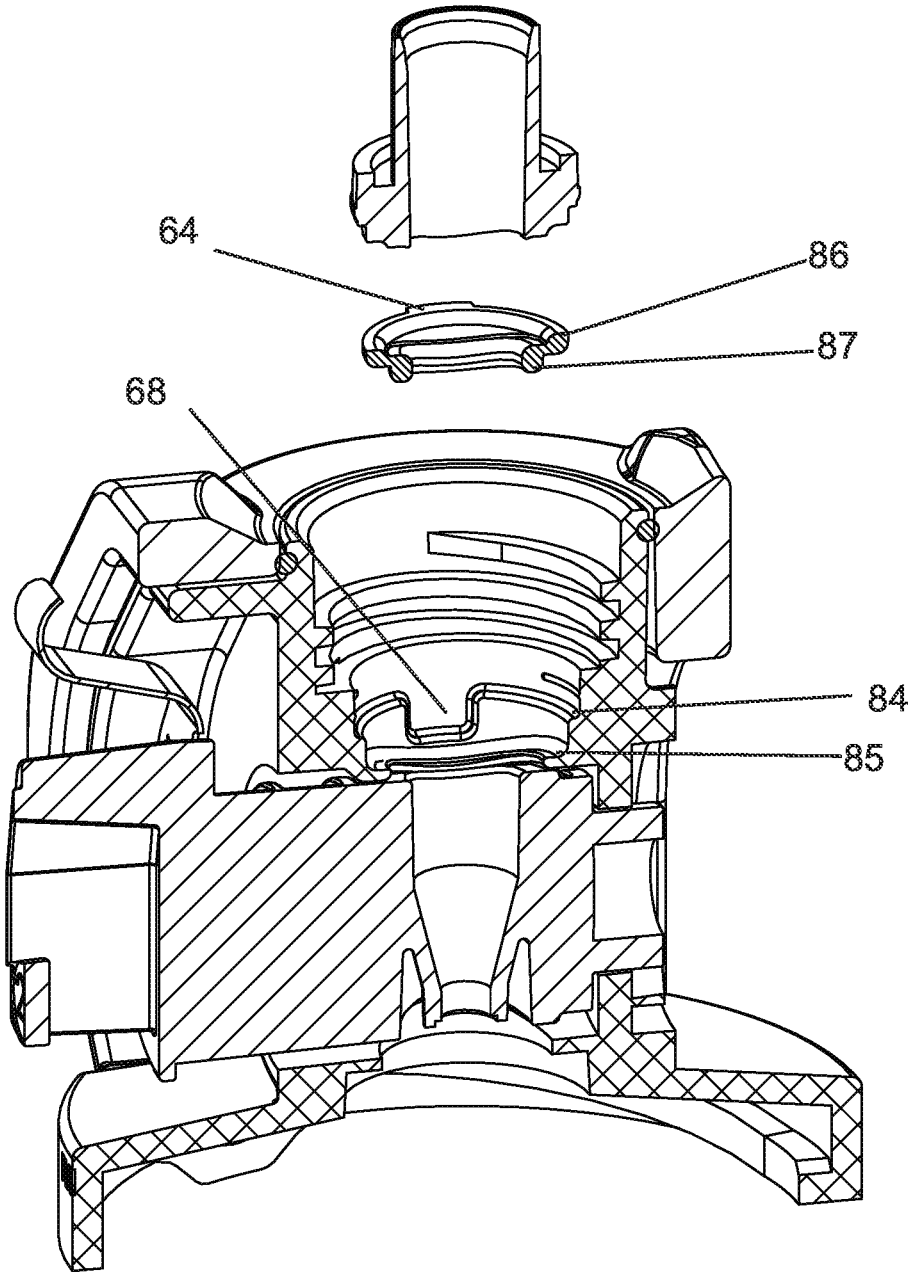
FIG. 39 is an isometric partially exploded section view of the nozzle assembly of FIG. 38.

FIGS. 38 and 39 illustrate isometric section views of the nozzle seal carrier, and nozzle seal. FIG. 38 depicts the adapter is connected to the nozzle body thus retaining the seal carrier in place. The nozzle seal carrier in turn retains the nozzle seal in operational position.

FIG. 39 illustrates one of two locating tabs 64 on the nozzle seal. The nozzle body cavity has a lip 85 on which the upper rib 86 of the nozzle seal is positioned in use. The lower rib 87 of the nozzle seal is positioned against the nozzle insert when in operation.

Figure 40:
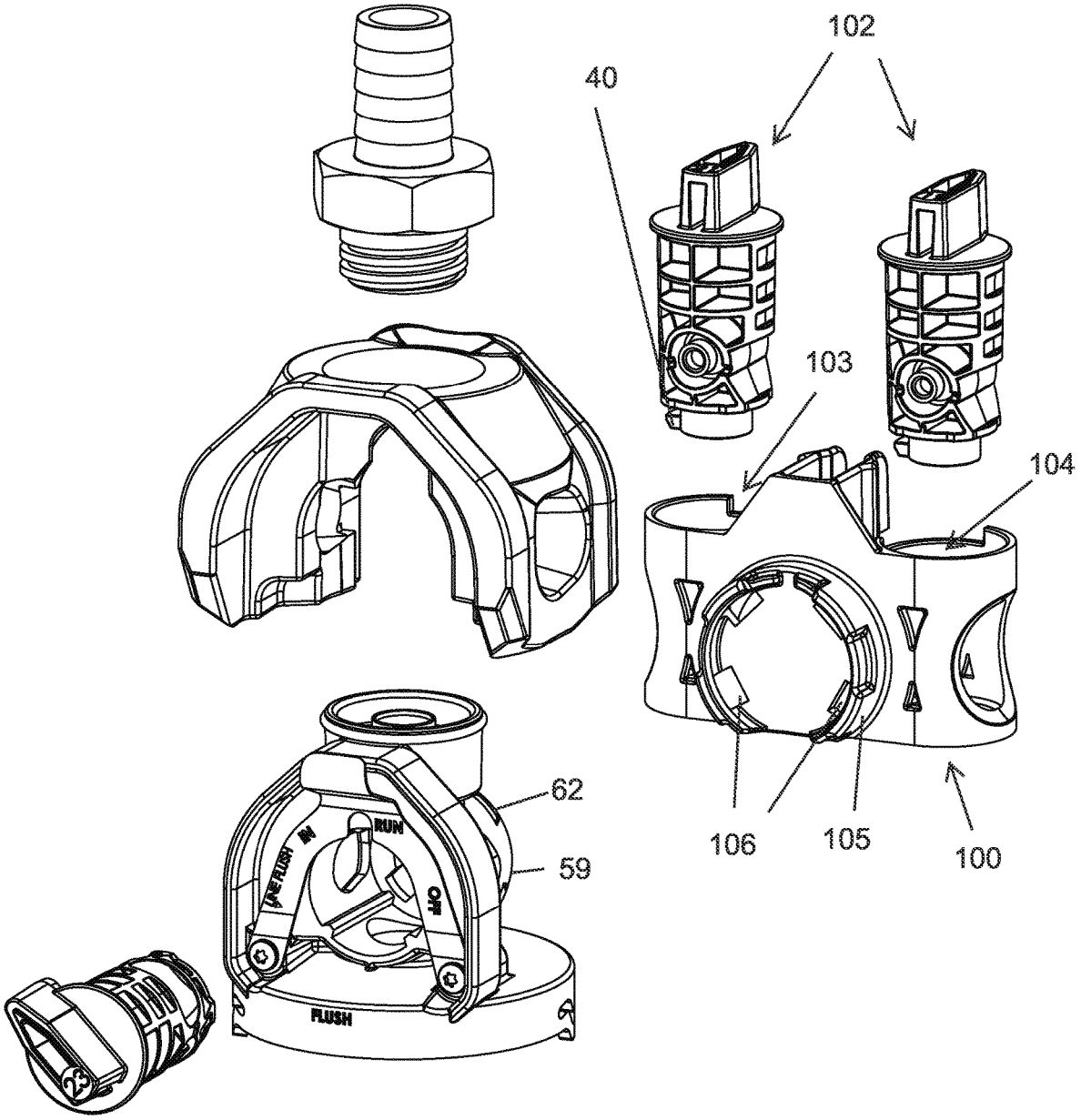
FIG. 40 is a perspective partially exploded view of a nozzle assembly and nozzle insert carrier.
Figure 41:
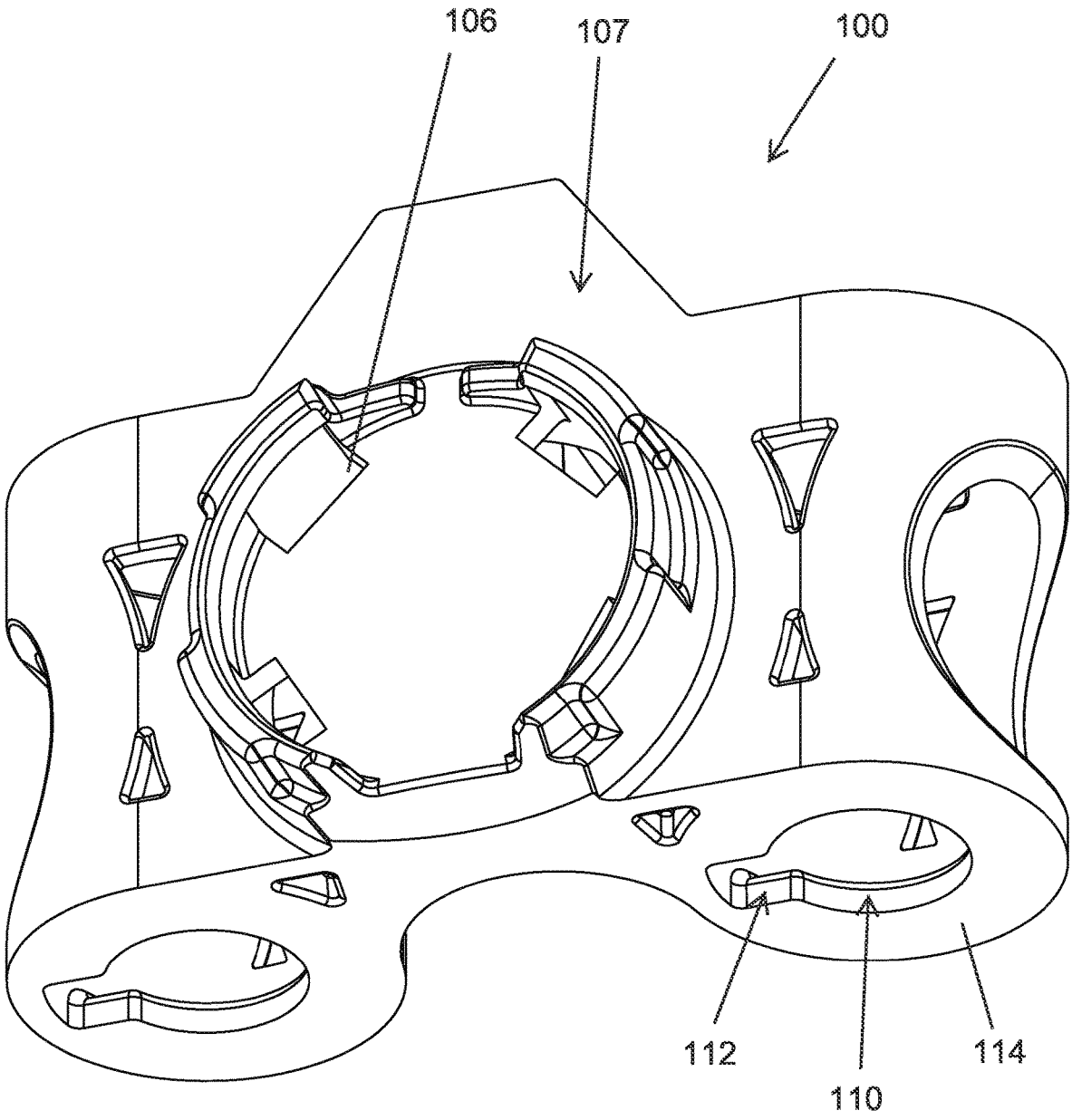
FIG. 41 is a perspective view of the nozzle insert carrier shown in FIG. 40.

FIG. 40 illustrates a perspective partially exploded view of an embodiment of a nozzle insert carrier 100 and nozzle assembly. The nozzle insert carrier has a cylindrical extension or mounting cap 105. The mounting cap is configured to be positioned over the cylindrical wall 59 extending from the rear of the nozzle body. A series of openings 106 and mating tabs 62 secures the nozzle insert carrier to the nozzle body. The depicted nozzle insert carrier has two nozzle insert carriers 103, 104 separated by a bridge 107. The cylindrical body of the nozzle insert is configured to be positioned into one of the cylindrical nozzle insert. As seen in more detail in FIG. 41, the bottom 114 of the insert housing is configured with a circular opening 110 configured for passage of the annular ring extending off the rear face of the nozzle insert. The bottom of the insert housing further has a keeper tab notch 112 extending from the circular opening and configured to allow for passage there through of the keeper tab 40 of the nozzle insert. The keeper tab is positioned through the keeper tab notch and the nozzle insert is then rotated to retain the nozzle insert in the nozzle insert housing, in the same fashion the nozzle insert is retained in the nozzle body recess as discussed previously.

Figure 42:
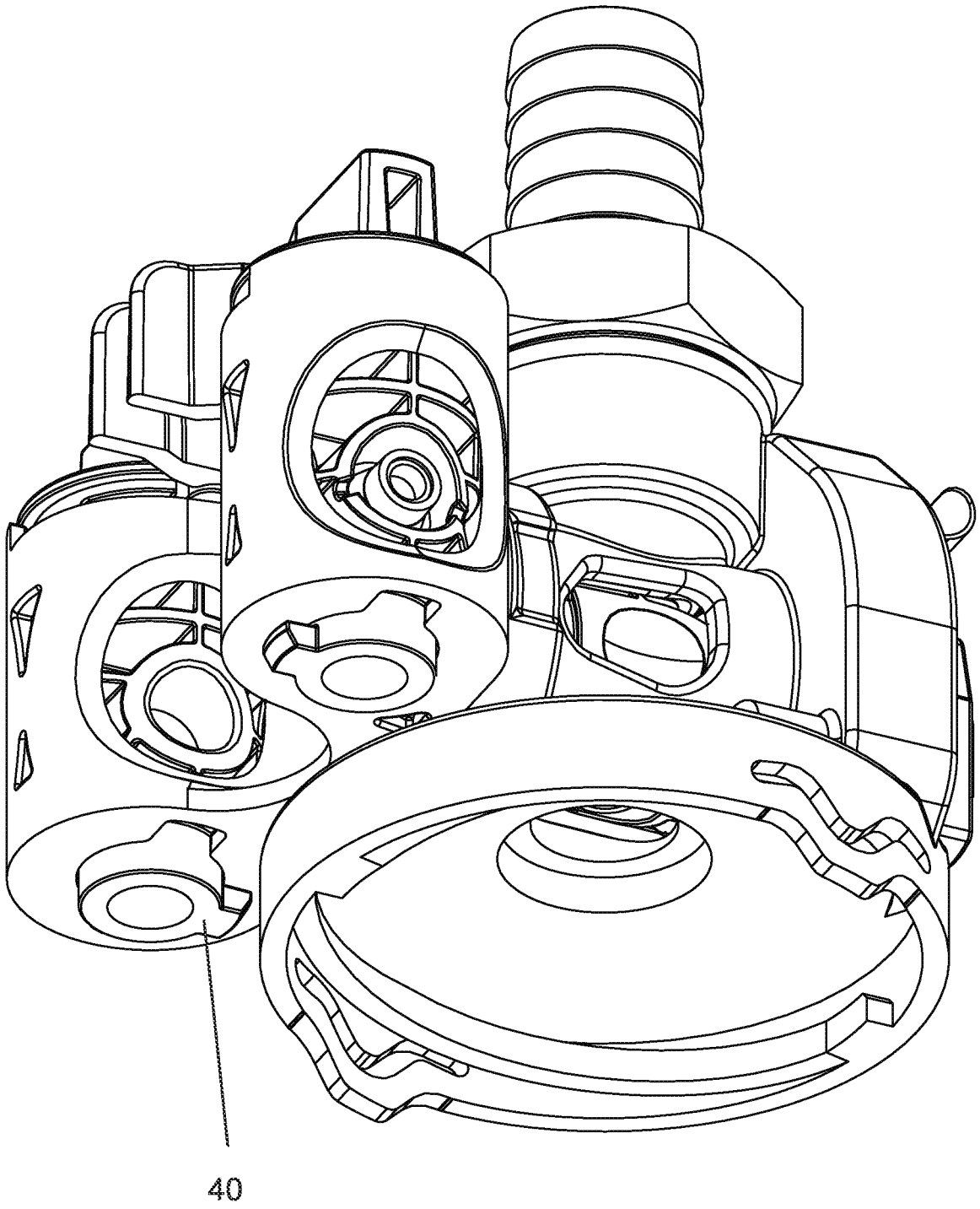
FIG. 42 is a perspective view of the nozzle insert carrier of FIG. 40 attached to a nozzle assembly.

FIG. 42 illustrates two nozzle inserts positioned in nozzle insert carriers.

Figure 43:
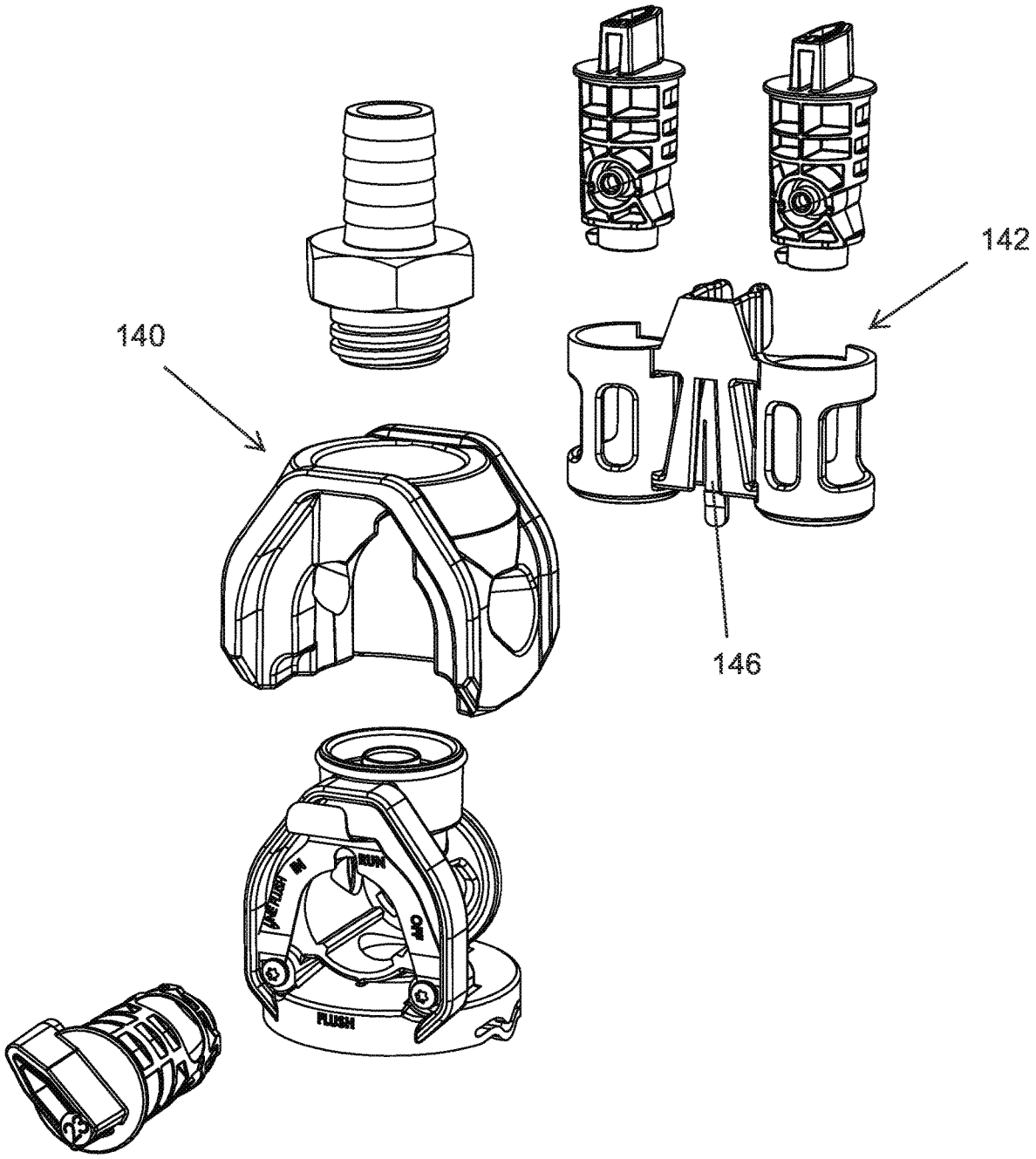
FIG. 43 is a perspective partially exploded view of a nozzle assembly and nozzle insert carrier.
Figure 44:
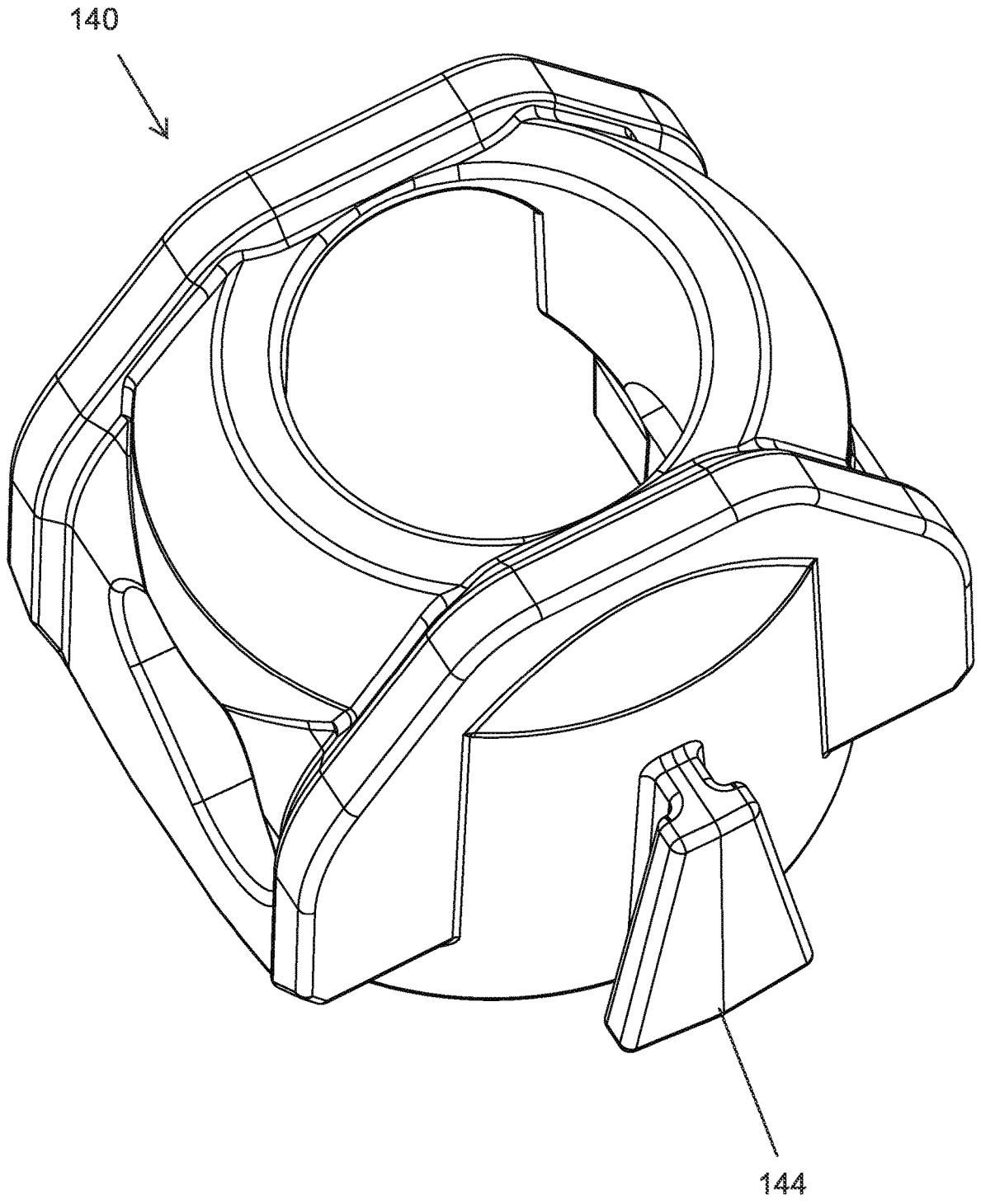
FIG. 44 is a perspective view of the weight shown in FIG. 43.
Figure 45:
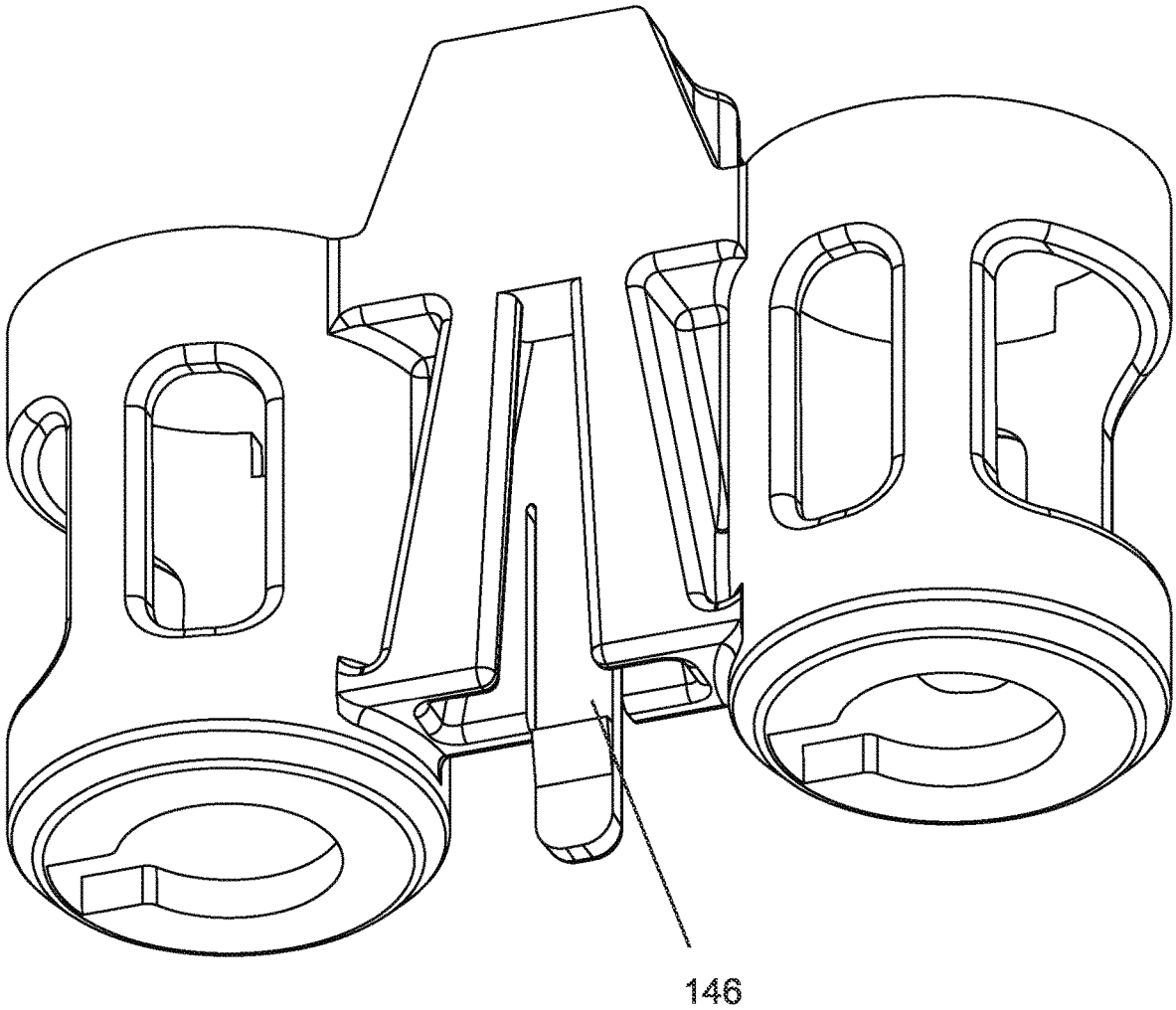
FIG. 45 is a perspective view of the nozzle insert carrier shown in FIG. 45.

FIG. 43 illustrates an alternate attachment between the nozzle insert carrier and nozzle assembly. The nozzle insert carrier is configured with an elongate slot that is configured for mating engagement with an elongate tab 144 of the weight 140. FIG. 44 illustrates a rear perspective view of an elongate tab 144 on the weight 140 configured for mating engagement with the elongate slot 146 of the nozzle insert carrier of FIG. 45.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A nozzle assembly having a side loading nozzle, said nozzle assembly comprising:

a nozzle body comprising a flow passage along a longitudinal flow axis of said nozzle body from a fluid input at a first end of said nozzle body to a fluid output at a second end of said nozzle body, said nozzle body comprising a face and defining a nozzle body recess formed in said nozzle body extending from said face through said nozzle body and intersecting said flow passage in a generally perpendicular orientation to said flow passage, said nozzle body recess defined by a substantially cylindrical wall within said nozzle body and an end wall, wherein said nozzle body recess end wall comprising a flange extending inward from said substantially cylindrical wall and defining a generally circular opening and defining a keeper tab notch in said flange, wherein said nozzle body recess rear wall comprising an inner surface defining said end wall and an outer surface;

a nozzle insert removably positioned within said bore in said nozzle body, said nozzle insert comprising an elongated insert body having an insert axis about which said nozzle insert rotates within said insert body, wherein said nozzle insert is rotatable to plural operating positions, said nozzle insert comprising a forward end face comprising a turning knob having a rounded point extending beyond an outer edge of said forward end face, wherein a nozzle bore extends through said insert body on an axis intersecting said insert axis, wherein said nozzle bore comprising a first end and a second end and configured to restrict fluid flow therethrough from said first end to said second end, wherein said nozzle bore is configured to align with said flow passage of said nozzle body to provide a continuous fluid passage, wherein said nozzle insert comprising a rear end face and a rearwardly-projecting annular ring of smaller diameter than said rear end face, said annular ring comprising a keeper tab, said annular ring being configured to pass through said generally circular opening of said nozzle body recess end wall and said keeper tab through said keeper tab notch of said nozzle body recess end wall when said nozzle insert is inserted into said nozzle body recess in the insert position, said keeper tab being configured to rotate along said outer surface of said nozzle bore rear wall when said nozzle insert is rotated between said plurality of positions, wherein said annular ring is configured to extend through said generally circular opening;

a biasing plate attached to said forward face of said nozzle body, wherein said biasing plate comprises a detent notch and a push tab located proximate to said detent notch, where said biasing plate is biased outward from said face of said nozzle body such that when said rounded tab of said nozzle insert aligns with said detent notch said biasing tab is configured to bias away from said forward face of said nozzle body to provide a detent to said rounded tab of said nozzle insert when said nozzle bore is aligned with said flow path of said nozzle body, wherein depression of said push tab biases said biasing plate toward said face of said nozzle body to release the detent of said detent notch on said rounded tab of said nozzle insert to allow said nozzle insert to rotate to a further operating position, wherein said nozzle bore is oriented such that fluid flows through said nozzle body from said first end to said second end when said knob is in the detent by said detent notch.

2. The nozzle assembly having a side loading nozzle of claim 1, wherein said substantially cylindrical wall extends beyond said rear wall defining said nozzle body recess, wherein said substantially cylindrical wall is configured for attachment to an end mount.

3. The nozzle assembly having a side loading nozzle of claim 2, wherein said end mount comprises a cap.

4. The nozzle assembly having a side loading nozzle of claim 2, wherein said end mount comprises a nozzle insert carrier.

5. The nozzle assembly having a side loading nozzle of claim 2, wherein one of said substantially cylindrical wall and said end mount comprises a series of tabs and the other of said substantially cylindrical wall and said end mount comprises a series of openings configured for mating engagement with said series of tabs.

6. The nozzle assembly having a side loading nozzle of claim 1, wherein said nozzle body is attached to a sprinkler body.

7. The nozzle assembly having a side loading nozzle of claim 1, wherein said nozzle body is configured for releasable attachment to a sprinkler body.

8. The nozzle assembly having a side loading nozzle of claim 1, wherein said outer surface of said end wall comprises a stop tab, wherein said stop tab is adjacent to said keeper tab notch and configured to stop rotation of said keeper tab.

9. The nozzle assembly having a side loading nozzle of claim 1, wherein said nozzle body comprises at least two ribs in said wall defining said nozzle body recess, wherein said two ribs are configured for aligning said nozzle insert when said nozzle insert is being inserted into said nozzle body.

10. The nozzle assembly having a side loading nozzle assembly of claim 1, wherein said nozzle insert comprises a substantially cylindrical shape having a channel formed in an exterior wall of said nozzle insert, said channel configured to direct fluid flow from said nozzle body out an opening in a side of said nozzle body.

11. The nozzle assembly having a side loading nozzle assembly of claim 1, wherein said nozzle insert comprises a stop depression, wherein said stop depression is configured to align with said flow channel to prevent flow through said nozzle body from said nozzle body inflow.

12. The nozzle assembly having a side loading nozzle of claim 1, wherein said nozzle assembly comprises a weight.

13. The nozzle assembly having a side loading nozzle of claim 1 wherein said nozzle body comprises a seal carrier and a nozzle seal, wherein said seal carrier retains said nozzle seal in said nozzle body fluid passage between said nozzle body and said nozzle insert, wherein said nozzle seal comprises a concave shape, wherein said nozzle seal comprises at least one positioning tab wherein said at least one positioning tab is positioned within a locating groove of said nozzle body to locate said nozzle seal in a correct position when said nozzle seal is positioned within said nozzle body.

14. A nozzle insert carrier and nozzle insert for loading into a complementary recess in a nozzle assembly comprising:

a nozzle insert comprising an elongated insert body comprising a generally cylindrical body having an insert axis about which said nozzle insert rotates, said nozzle insert comprising a forward end face comprising a turning knob having a rounded point extending beyond an outer edge of said forward end face, wherein a nozzle bore extends through said elongated insert body on an axis intersecting said insert axis, wherein said nozzle bore comprising a first end and a second end and configured to restrict fluid flow therethrough from said first end to said second end, said nozzle insert comprising a rear end face and a rearwardly-projecting annular ring of smaller diameter than said rear end face, said annular ring comprising a keeper tab, a nozzle insert carrier comprising a nozzle housing defining a generally cylindrical housing comprising a first end and a second end and configured to receive said elongated insert body, wherein said second end comprises a circular opening having a notch opening extending therefrom to be configured for accepting said rearwardly-projecting annular ring and keeper tab of said nozzle insert, wherein placement of said annular ring and keeper tab of said nozzle insert through said generally circular opening of said nozzle insert carrier and subsequent rotation of said turning knob of said nozzle insert secures said nozzle insert to said nozzle insert carrier; and wherein said nozzle insert carrier is configured to attach to the nozzle assembly having said complimentary recess configured for operationally accepting said nozzle insert such that said nozzle insert carrier is configured to retain the nozzle insert when said nozzle insert is not positioned in said complimentary recess.

15. The nozzle insert carrier and nozzle insert of claim 14, wherein said nozzle insert carrier comprises two nozzle housings.

16. The nozzle insert carrier and nozzle insert of claim 14, wherein said nozzle insert carrier is configured with a generally circular mounting cap, wherein said generally circular mounting cap is configured to attach to a circular rear wall of a nozzle housing such that said mounting cap is positioned over said wall.

17. The nozzle insert carrier and nozzle insert of claim 16, wherein one of said mounting cap and said circular rear wall of said nozzle housing is configured with a series of tabs and the other of said mounting cap and said circular rear wall is configured with a series of openings configured to mate with said tabs to attach said mounting cap to said nozzle body.

18. The nozzle insert carrier and nozzle insert of claim 14, wherein said nozzle assembly comprises a weight, wherein said nozzle insert carrier is configured to attach to said weight.

19. The nozzle insert carrier and nozzle insert of claim 18, wherein said one of said weight and said nozzle insert carrier comprises an elongate tab, wherein the other of said weight and said nozzle insert carrier comprises an elongate groove configured for mating retention of said nozzle insert carrier on said weight.

* * * * *